US007156390B2

(12) United States Patent
Eitel et al.

(10) Patent No.: US 7,156,390 B2
(45) Date of Patent: Jan. 2, 2007

(54) DEVICES FOR ALIGNING SHEETS

(75) Inventors: Johann Emil Eitel, Thüngen (DE); Kurt Georg Nagler, Zell/Main (DE); Johannes Georg Schaede, Würzburg (DE)

(73) Assignee: Koenig & Bauer Aktienegesellschaft, Wurzburg (DE)

( * ) Notice: Subject to any disclaimer, the term of this patent is extended or adjusted under 35 U.S.C. 154(b) by 420 days.

(21) Appl. No.: 10/433,608

(22) PCT Filed: Nov. 28, 2001

(86) PCT No.: PCT/DE01/04477

§ 371 (c)(1),
(2), (4) Date: Jun. 16, 2003

(87) PCT Pub. No.: WO02/48012

PCT Pub. Date: Jun. 20, 2002

(65) Prior Publication Data

US 2004/0051236 A1 Mar. 18, 2004

(30) Foreign Application Priority Data

Dec. 15, 2000 (DE) ..... 100 62 819

(51) Int. Cl.
*B65H 9/00* (2006.01)

(52) U.S. Cl. ..... 271/245; 271/250; 271/252; 271/277; 271/227

(58) Field of Classification Search ..... 271/275, 271/243, 246, 245, 272, 236, 237, 227, 231, 271/249, 252, 250, 255, 241, 276
See application file for complete search history.

(56) References Cited

U.S. PATENT DOCUMENTS 3,743,277 A 7/1973 Bolza-Schünemann et al.

(Continued)

FOREIGN PATENT DOCUMENTS

DE 2 046 602 6/1972

(Continued)

*Primary Examiner*—Eileen D. Lillis
*Assistant Examiner*—Kaitlin Joerger
(74) *Attorney, Agent, or Firm*—Jones, Tullar & Cooper, P.C.

(57) ABSTRACT

The invention relates to devices for aligning sheets (1), which are overlapped with an offset and supplied to the device by a stream feeder and which can be transferred to a device (63) that is located downstream, after alignment of the front edge and one lateral edge of the sheets. At least pant of a sheet can be brought to rest on the periphery of an alignment cylinder (62), which is used to align the front edge of the sheet by means of front lay marks located on the periphery of said cylinder. At least one recess is provided on the periphery of the alignment cylinder, which, by the application of a negative pressure to said recess allows at least part of the sheet to be fixed by friction on the periphery of the alignment cylinder, in such a way that in the contact zone, drive forces from said cylinder can be transferred by friction to the sheet. A measuring device (64) determines the offset of a lateral edge of the sheet in relation to a predetermined set alignment. A transversal displacement device is used to align a lateral edge of the sheet in accordance with the measurement result of the measuring device. The acceleration and/or speed and/or angle of rotation of the drive motor for driving the rotation of the alignment cylinder can be controlled or adjusted according to predetermined laws of motion, in particular in accordance with the angle of rotation of the alignment cylinder.

35 Claims, 30 Drawing Sheets

U.S. PATENT DOCUMENTS

| | | | | |
|---|---|---|---|---|
| 3,942,787 | A * | 3/1976 | Bolza-Schunemann | 271/237 |
| 4,588,184 | A | 5/1986 | Jeschke | |
| 4,615,520 | A | 10/1986 | Jeschke et al. | |
| 4,702,469 | A | 10/1987 | Jeschke et al. | |
| 5,094,442 | A | 3/1992 | Kamprath et al. | |
| 5,527,027 | A | 6/1996 | Flade et al. | |
| 5,938,193 | A | 8/1999 | Bluemle et al. | |
| 5,947,469 | A | 9/1999 | Henn et al. | |
| 6,027,850 | A * | 2/2000 | Kawakami et al. | 430/201 |
| 6,213,282 | B1 | 4/2001 | Mokler et al. | |
| 6,264,196 | B1 | 7/2001 | Lötsch | |

FOREIGN PATENT DOCUMENTS

| | | | |
|---|---|---|---|
| DE | 24 60 747 | | 7/1976 |
| DE | 28 36 098 | | 2/1980 |
| DE | 23 13 150 | C3 | 12/1981 |
| DE | 42 39 732 | A1 | 6/1994 |
| DE | 196 18 030 | A1 | 11/1997 |
| EP | 0 120 348 | | 10/1984 |
| EP | 0 120 358 | | 10/1984 |
| EP | 0 469 866 | A1 | 2/1992 |
| EP | 0 716 287 | A2 | 6/1996 |
| EP | 0 753 407 | A2 | 1/1997 |
| EP | 0 947 455 | A1 | 10/1999 |
| FR | 2 512 743 | | 9/1981 |
| WO | WO 97/35795 | | 10/1997 |

* cited by examiner

DEVICES FOR ALIGNING SHEETS

FIELD OF THE INVENTION

The present invention is directed to devices for aligning sheets. An alignment cylinder is shiftable axially. A feed table, that guides the sheets to the alignment cylinder, is also shiftable in the axial direction of the alignment cylinder.

BACKGROUND OF THE INVENTION

A device and a method for aligning sheets is known from EP 0 120 348 A2. There, the alignment of the front edges of the sheets takes place in a way wherein the sheets, arranged in the manner of fish scales, are fed to the device and are fed to an alignment cylinder of the device at a conveying speed which is greater than the circumferential speed of the alignment cylinder. Front lays are arranged on the circumference of the alignment cylinder, and against which the front edges of the sheets can be placed. Because of the relative speeds of the sheets and the front lays, the front edge of the sheet is braked at least slightly, and the front edge of the sheet is aligned because of this. Following the alignment of the front edge of the sheet, the area of the front edge of the sheet is fixed on a suction strip carried by the alignment cylinder by the application of a vacuum to the suction strip. The sheet is looped around the circumference of the alignment cylinder because of the continued rotatory driving of the alignment cylinder. Following the alignment of the front edge of the sheet and prior to transferring the sheet to a downstream-located device, a lateral offset of a lateral edge of the sheet is measured by a measuring device. The suction strip, on which the front edge of the sheet is fixed, is linearly displaced axially in the direction of the axis of rotation of the alignment cylinder as a function of the result of the measurement in order to align the lateral edge of the sheet in accordance with the desired alignment. The result of this is that the sheet can be transferred, placed in the correct position in regard to its front edge, as well as to a lateral edge, to a subsequent device, for example a sheet-printing press.

A device for sheet guidance of a sheet-fed rotary printing press is known from DE 23 13 150 C3. The sheets are conducted on a feed table in scaled layers to the device and then away from the device. The use of suction rollers, on whose circumferences recesses are provided, for conveying the sheets, which are lying flat on the feed table, is described. The sheet can be fixed on the circumference of the suction roller by the application of a vacuum. In this device, the suction roller is arranged in a recess of the feed table in such a way that the sheets, which lie flat on the feed table and are placed tangentially against the circumference of the suction roller, can be driven. It is achieved by this that the respective sheets come into contact with the suction roller only in a line-shaped contact area. The driving forces are frictionally transmitted, by the suction roller, to the sheet in the line-shaped contact area. Thus no looping of the sheets around the suction rollers is required.

A device with a suction drum is known from WO 97/35795 A1, and to whose circumference the sheets to be conveyed can be frictionally fixed by the application of a vacuum. In this case, the drive mechanism of the suction drum is structured in such a way that the number of revolutions and/or the angle of rotation of the suction drum can be controlled by an independent electrical motor in accordance with pre-selected movement laws.

A sheet-feeding device for printing presses is known from DE-AS 20 46 602. The lateral offset of a lateral edge of a sheet, in relation to a desired orientation, can be detected by a measuring device. For aligning the lateral edge of the sheet, it is possible to displace an alignment cylinder, on whose circumference the sheet is fixed, axially, in the direction of the cylinder's axis of rotation, as a function of the measurement result.

A device for measuring the position of the lateral edge of a sheet is known from EP 0 120 348 A2. This measuring device essentially consists of two measuring heads which, for measuring the position of the lateral edges, work together with interrogation gaps that are arranged at the circumference of a conveying roller. In order to be able to set the measuring heads to accommodate different sheet widths, the measuring heads are manually displaceable on a supporting cross-beam which is arranged above the sheet conveying level.

A contactless operating device for measuring the position of sheets is known from EP 0 716 287 A2. The lateral edges of the sheets can be measured by an optical system.

SUMMARY OF THE INVENTION

The object of the present invention is directed to providing devices for the alignment of sheets.

In accordance with the present invention, this object is attained by the use of a sheet alignment device that has an alignment cylinder which can be shifted in its axial direction. A feed table, which guides sheets to the alignment cylinder, can also be shifted in the axial direction of the alignment cylinder. The alignment cylinder has at least one front register lay. The circumferential speed of the alignment cylinder is selected to be 0.7, to 0.9 times the sheet conveying speed when the sheet front edge contacts the front register lays. A sheet hold-down roller, which can work in cooperation with the alignment cylinder, has a helical cross-sectional shape.

The advantages to be obtained by the invention consist, in particular, in that, in the course of being conveyed by the alignment cylinder, the sheets can be simultaneously aligned in respect to their front edge, as well as in respect of their lateral edge. The alignment of the sheets, in respect to their lateral edge, can be advantageously achieved in that, following the alignment of the sheet front edge at the front lays, the alignment cylinder is axially displaced in the direction of its axis of rotation.

It is furthermore advantageous if the drive motor for the rotational driving of the alignment cylinder can be controlled or regulated as a function of predetermined movement laws, in particular as a function of the alignment cylinder angle of rotation. By this, it becomes possible to also take over sheets of different lengths in the correct position at the front lay by varying the circumferential speed of the alignment cylinder during its rotation, and to transfer the sheets, now exactly aligned, to downstream-located sheet conveying devices.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
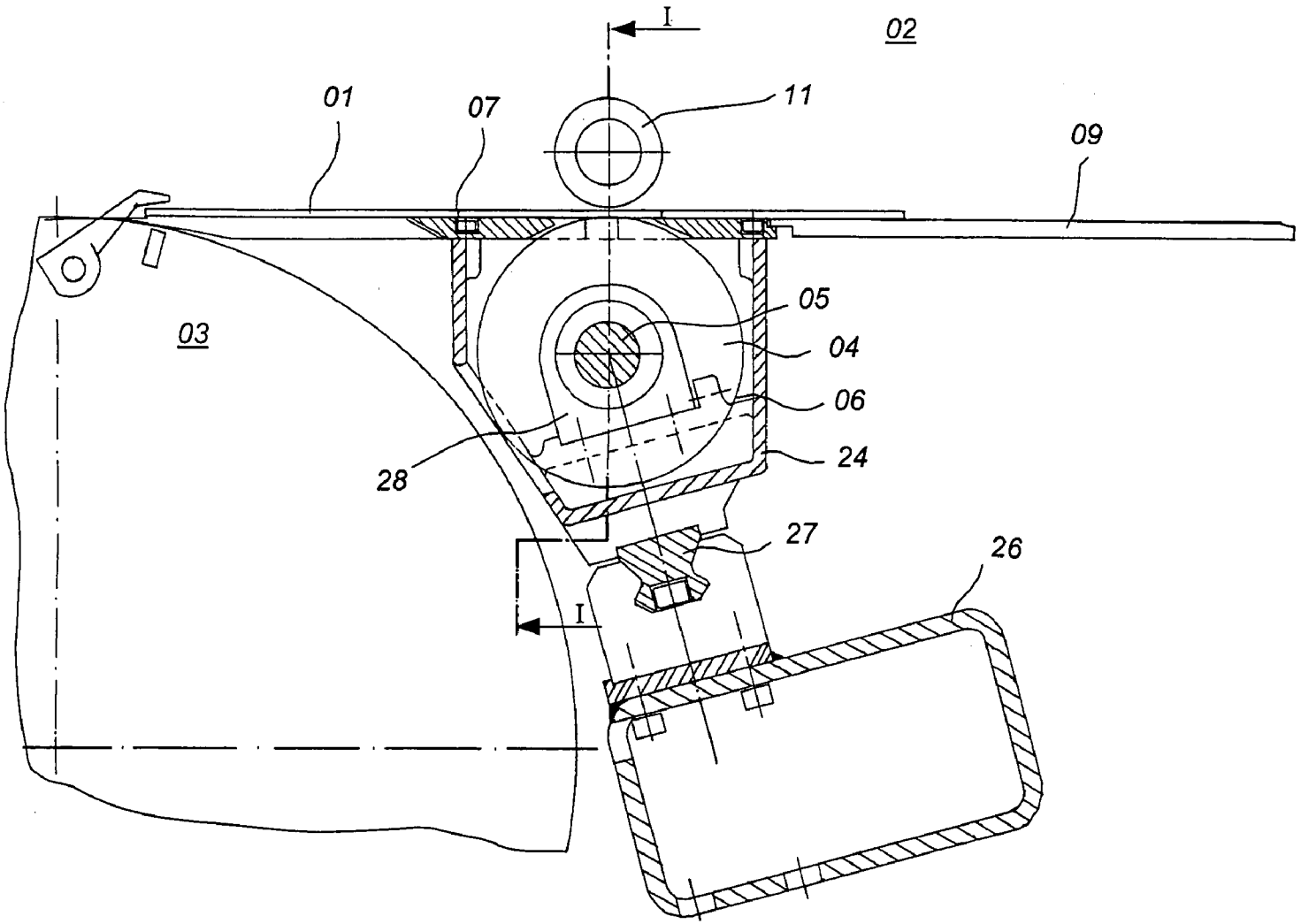
FIG. 1, a cross-sectional view of a first embodiment of a device for the continuous alignment of sheets in accordance with the present invention, FIG. 2, the device in accordance with FIG. 1, showing an enlarged portion during a first phase for aligning the front edge of a sheet, FIG. 3, the device in accordance with FIG. 2 in a second phase for aligning the front edge of a sheet, FIG. 4, the device in accordance with FIG. 1 in longitudinal section taken along the section line I—I of FIG. 1, FIG. 5, a longitudinal view of a second embodiment of a device in accordance with the present invention, FIG. 6, the device in accordance with FIG. 5 in cross section, FIG. 7, a perspective view of a sheet feeder in accordance with a third embodiment of the present device, FIG. 8, the sheet feeder in accordance with FIG. 7 in a second perspective plan view, FIG. 9, the sheet feeder in accordance with FIG. 7 in section in a perspective plan view, FIG. 10, the seating of the alignment cylinder for the sheet feeder in accordance with FIG. 7 in a perspective plan view, FIG. 11, the sheet feeder in accordance with FIG. 10 with a feed table and with schematically represented sheets, in a perspective plan view, FIG. 12, a perspective view of an embodiment of a sheet conveying device for a sheet feeder in accordance with FIG. 7, FIG. 13, a perspective view of a sheet guidance device for a sheet feeder in accordance with FIG. 7, FIG. 14, a first phase, during the alignment of a moving sheet, in a sheet feeder in accordance with FIG. 7 in a perspective plan view, FIG. 15, a second phase, during the alignment of the sheet, in accordance with FIG. 14 in a perspective plan view, FIG. 16, a phase during the alignment of the sheet in accordance with FIG. 14 in a perspective plan view, FIG. 17, diagrams showing path, speed and acceleration of the rotational movement of an alignment cylinder applied over the angle of rotation of the alignment cylinder during one revolution, FIG. 18, diagrams showing path, speed and acceleration of the linear movement of an alignment cylinder axially in the direction of its axis of rotation applied over the angle of rotation of the alignment cylinder during one revolution, FIG. 19, a top perspective view of a device for measuring the position of the lateral edges of a sheet in a sheet feeder in accordance with FIG. 7, FIG. 20, the device in accordance with FIG. 19, in a perspective view from below, FIG. 21, the device in accordance with FIG. 19, in a lateral plan view from the rear, FIG. 22, the device in accordance with FIG. 19, in a lateral plan view from a transverse side, FIG. 23, the device in accordance with FIG. 19, in a partially sectional representation in a perspective plan view, FIG. 24, the drive mechanism of the device in accordance with FIG. 19, in a perspective plan view, FIG. 25, a gear stage of a device in accordance with FIG. 19, in a perspective plan view from below, FIG. 26, the drive motor of a device in accordance with FIG. 19, in a perspective plan view from below, FIG. 27, a cover element for a device in accordance with FIG. 19, with an associated guide device, in a perspective plan view from below, FIG. 28, a partial element of a coupling element in accordance with the present invention, in a perspective plan view, FIG. 29, a perspective view of a further partial element of a coupling element, FIG. 30, a coupling element in a perspective plan view, FIG. 31, a coupling for transmitting a driving torque to an axially displaceable shaft, in a lateral view, FIG. 32, a coupling in accordance with FIG. 31 during a first phase for the rotational drive of an axially displaceable shaft, and in FIG. 33, a coupling in accordance with FIG. 32 during a second phase for the rotational drive of an axially displaceable shaft.
Figure 3:
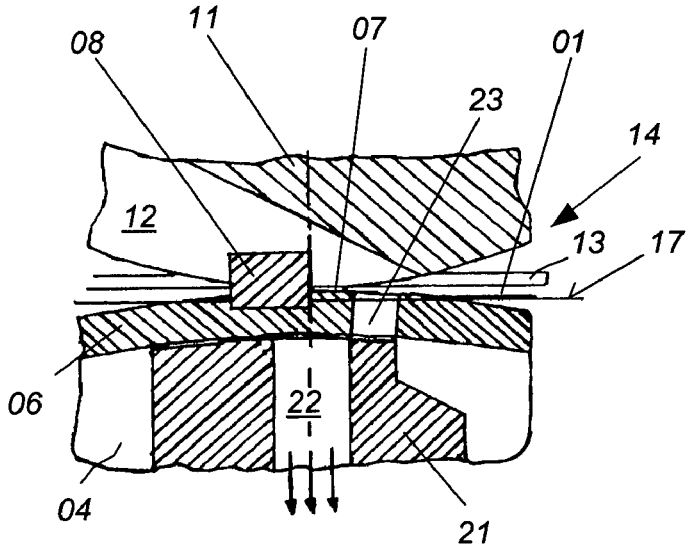
Figure 4:
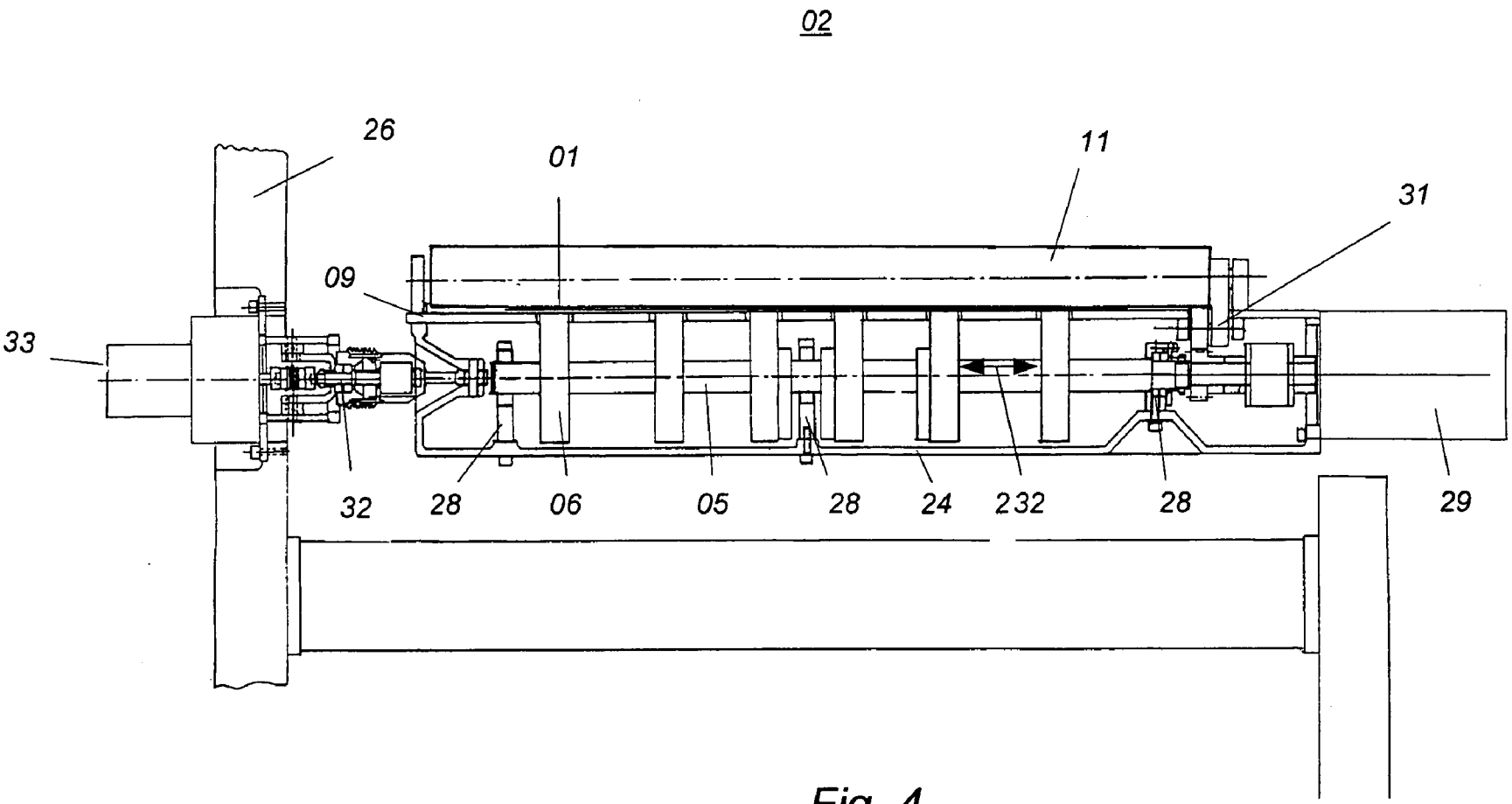

A device 02 for aligning sheets 01, in accordance with a first preferred embodiment of the present invention, is represented, partly in cross section, in FIG. 1. Devices of this type are used for aligning sheets, which are conveyed to the device in an overlapping or shingled manner from a device for overlapping, which is not represented, in their correct positions so that the sheets, now correctly aligned, can be transferred to a downstream-located web-fed printing press, for example. As depicted in FIG. 1, the sheets 01, which are lying one behind the other, are fed to the device 02 in such a way that each front edge 07 of the respectively rear or trailing sheet 01 rests underneath the sheet 01 respectively leading, or lying in front of it. The device 02 is used, in particular, to align the sheets 01, conveyed in an overlapping manner during their conveyance through the device 02, in their correct position in respect to the sheet front edge 07 and in respect to the sheet lateral edge so that, after leaving the device 02, the sheets 01 can be conveyed, in their correct position, to a downstream-located device 03, such as, for example, a transfer cylinder 03 of a web-fed printing press. An alignment cylinder 04, which is substantially constructed of a drive shaft 05 and suction rollers 06, which suction rollers 06 are arranged spaced apart on drive shaft 05, is used for aligning the sheet 01 in the device 02, as seen in FIG. 4. The alignment cylinder 04 has a diameter of between 140 mm and 150 mm, and in particular has a diameter of approximately 144 mm. The function of the device 02, in the course of aligning the front edge 07 of the sheets 01, can be seen in FIGS. 2 and 3 in particular.

Figure 2:
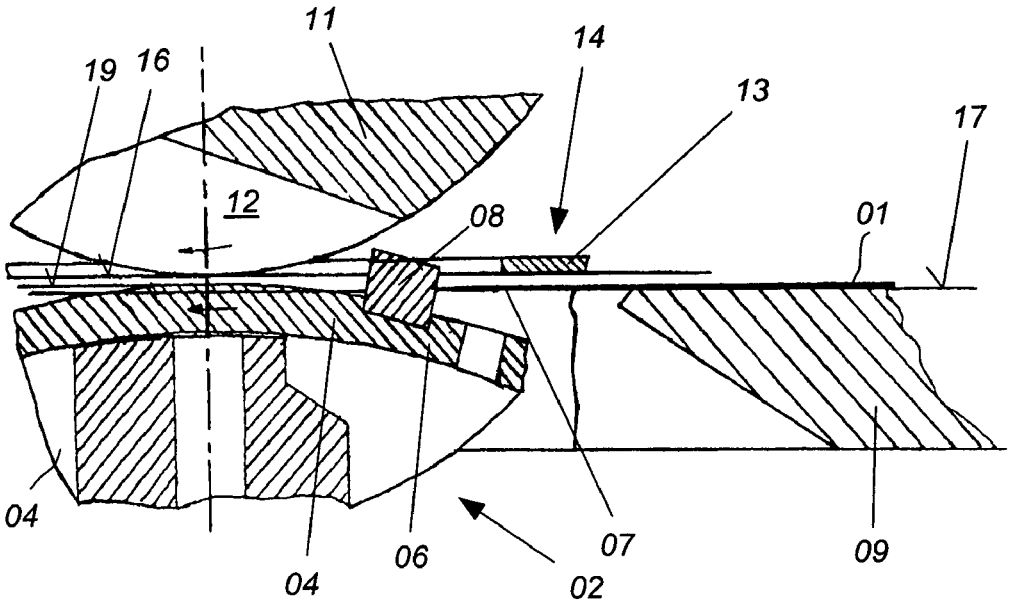

The upper portion, which is embodied in the manner of a suction roller 06, of the alignment cylinder 04 is represented in FIG. 2. A front lay 08, against whose front the front edge 07 of the sheets 01 can come to rest for aligning the front edge 07 of the sheets 01, is fastened on the circumference of the alignment cylinder 04 along a line extending parallel with the axis of rotation of the alignment cylinder 04. The alignment cylinder 04 is driven at a circumferential speed which is at least slightly less than the conveying speed of the sheets 01 on a feed table 09. The sheets 01 are conveyed to the device 02 synchronously with the movement of the front lay 08, so that each front edge 07 can reach the contact area of the front lay 08. Because of the relative speed differential between the front lay 08 and the sheet front edge 07, the sheet front edge 07 runs up to, and against the front lay 08 and because of this it can be continuously aligned during the contact phase between the sheet front edge 07 and the front lay 08. It has been shown to be particularly advantageous if, during the contact between the front lay 08 and the front edge 07 of the sheet 01, that the circumferential speed of the alignment cylinder 04 corresponds, at least at times, to approximately 0.7 to 0.9 times, and in particular to 0.8 times, the conveying speed of the layered sheets 01 immediately prior to contact between the front lay 08 and the front edge 07 of the sheet. "Immediately prior to contact . . . " means "during first contact". The alignment cylinder 04 performs one revolution for each conveyed sheet 01.

The front lay 08 has a height of 2 mm to 4 mm, and in particular, has a height of 3 mm, above the circumference of the alignment cylinder 04.

In order to be able to align the sheet 01 exactly on the front lays 08, a sheet hold-down roller 11 is arranged opposite the alignment cylinder 04. A recess 12 is provided on the circumference of the sheet hold-down roller 11 in such a way that, as can be seen in FIG. 3, the front lay 08 on the alignment cylinder 04 can be received in a contact-free manner when passing through the gap between the alignment cylinder 04 and the sheet hold-down roller 11. The sheet hold-down roller 11 is driven by the alignment cylinder 04 through an appropriate gear arrangement, not specifically shown, and at a gear ratio 1:1, so that the alignment cylinder 04 and the sheet hold-down roller 11 move synchronously. The outer diameter of the sheet hold-down roller 11 is helically configured, wherein the largest radius of the sheet hold-down roller 11 is arranged approximately in the area of the recess 12 for the front lay 08. It is achieved by this configuration of the sheet hold-down roller that the gap between the sheet hold-down roller 11 and the alignment cylinder 04 is minimized during each alignment phase of the front edge 07. Thereafter the gap is increased again in the course of the further rotation of the sheet hold-down roller 11 so as not to hamper the conveyance of the sheets 01.

A hold-down plate 13, which is arranged in an inlet area 14, as seen in FIGS. 2 and 3, is also used for stabilizing the sheets 01 during their alignment at the front lay 08. In order to be able to configure the sheet alignment device 02 optimally as a function of the various method parameters, in particular as a function of the paper quality used, it is possible to support the feed table 09 and/or the hold-down roller 11 and/or the hold-down plate 13 so that they can be adjusted in height in respect to the alignment cylinder 04. Based on the method parameters to be taken into consideration, the distance between a hold-down roller tangential plane 16, measured when the maximum radius of the sheet hold-down roller 11 passes the alignment cylinder 04, should be a distance of approximately 0.8 mm from the surface 17 of the feed table 09. The alignment cylinder 04 is arranged below the feed table 09 in such a way that the sheets 01 come into contact substantially tangentially with the circumference of the alignment cylinder 04. However, departing from an ideal tangential arrangement, the alignment cylinder 04 may be slightly upwardly displaced, so that an alignment cylinder tangential plane 19 extends along the alignment cylinder 04 at a slight distance, for example 0.5 mm, above the surface 17 of the feed table 09. It is achieved by this, as can be seen in particular in FIG. 3, that a sheet 01 is slightly lifted in the contact area with the alignment cylinder 04, so that an optimal placement of the sheet 01 on the circumference of the alignment cylinder 04 is possible, and the driving forces can be frictionally transferred to the sheet 01 from the alignment cylinder 04 over a contact surface of sufficient size.

As depicted in FIG. 3, a suction element 21 is arranged on the inside of the suction roller 06, which is a part of the alignment cylinder 04. A suction chamber 22 is provided in the suction element 21, and from which air is permanently generated and aspirated by the use of a vacuum source, which is not specifically represented, so that an underpressure or suction of 0.2 to 0.6 bar prevails in the suction chamber 22. In the phase that is represented in FIG. 3, the front edge 07 of the sheet 01 is already aligned in the correct position and rests against the front lay 08. As soon as a recess 23 in the circumference of the suction roller 06 has reached the area above the suction chamber 22, the underpressure or vacuum prevailing in the suction chamber 22 is transmitted into the recess 23, so that the sheet 01 is frictionally fixed in place on the circumference of the suction roller 06. The result of this is that, when the sheet is entering the contact area with the suction roller 06, the sheet 01 is initially aligned by the front lays 08 in the correct position in respect to its front edge 07, and subsequently is fixed in place on the suction roller 06 by the suction chamber 22 and by the recess 23 working together.

As can be seen in FIG. 1, the sheets 01 essentially lie flat on the sheet level defined by the surface 17 of the feed table 09 during the entire time of their conveyance through the device 02 for the alignment of sheets in accordance with the present invention. Following the alignment of the front edge 07 of sheet 01 in the correct position, the sheet 01 is fixed in place in the device 02 by at least one of the vacuum receiving recesses 23, which are provided, starting at the front lay 08, one behind the other on the circumference of the suction roller 06, so that the suction roller 06 is frictionally connected with the sheet 01 in rectangular contact areas and can drive the sheet 01 in the sheet conveying direction.

Following the alignment of the sheet front edge 07, an offset of a lateral edge of the sheet 01, in respect to a predetermined desired alignment, is measured by the use of a measuring device, which is not specifically represented. As a function of the result of the sheet lateral offset measurement, the sheet 01 is displaced transversely, in respect to the sheet conveying direction, until the sheet lateral edge extends along the desired alignment. For aligning the lateral edges of the sheets 01, the alignment cylinder 04 can be axially displaced in the direction of its axis of rotation. In accordance with the representation in FIG. 1, the alignment cylinder can be axially displaced out of, or into the drawing plane. To make this adjustment movement possible, the alignment cylinder, together with the drive shaft 05, is fastened in a first frame element 24, as seen in FIG. 1, which, in turn, is axially seated in the direction of the axis of rotation of the alignment cylinder 04 on a second frame element 26, which can be mounted fixed to a rack, as seen in FIG. 4. For this purpose, the first frame element 24 can be embodied as a linear unit, which is seated in a rolling bearing, for example, and which can come into engagement with a prismatically configured linear guide 27 at the second frame element 26.

The alignment cylinder 04 can be, and in particular together with the first displaceably seated frame element 24, accelerated or braked linearly in the direction of the axis of rotation of the alignment cylinder 04 at a rate of up to +/−15 $m/s^2$.

A transverse displacement device 32 for effecting the axial shifting of the alignment cylinder 04 is embodied in such a way that the alignment cylinder 04 can be linearly displaced, in particular together with the first displaceably seated frame element 24, from a zero position through a distance of up to +/−8 mm, and in particular through a distance of up to +/−5 mm, in the direction of the axis of rotation of the alignment cylinder 04.

The device 02 for the alignment of sheets is represented in FIG. 4 along the section line I—I of FIG. 1. A total of six suction rollers 06 are arranged, fixed against relative rotation, on the drive shaft 05 for conveying the sheet 01, which is located between the sheet hold-down roller 11 and the feed table 09, in the conveying direction. The drive shaft 05 of the alignment cylinder 04 is rotatably seated on the first frame element 24 in bearing points 28 by schematically represented rolling bearings and can be rotatably driven by the operation of a drive shaft drive motor 29. The drive motor 29 is also fastened on the first frame element 24 and also drives the sheet hold-down roller 11 via a gear 31 synchronously with the drive shaft 05. The sheet hold-down roller 11 is also fastened on the first frame element 24 so that, as a result, the drive shaft 05, together with the suction rollers 06, the drive motor 29, the gear 31 and the sheet hold-down roller 11, can be linearly displaced by the linear movement of the first frame element 24 in the direction of the movement arrow 232, i.e. in the direction of the axis of rotation of the drive shaft 05, from a zero position in both directions. A motor, for example a linear motor 33, whose linearly driveable power take-off shaft acts on the left end of the first frame element 24, is fastened on the second frame element 26 and is usable for driving the first frame element 24 in the direction of the movement arrow 232. Driven by the drive motor 33, the first frame element 24 can be moved transversely in respect to the conveying direction of the sheets 01, so that the lateral edge of the sheet 01 to be aligned can be aligned in the desired alignment as a function of the previously determined measurement result.

The drive motor 29 for the rotational driving of the drive shaft 05 can be controlled and regulated as a function of predetermined movement laws, and in particular as a function of the angle of rotation of the suction rollers 06. It is thus possible to preset the acceleration, speed or the angle of rotation of the drive motor 29 for achieving desired movement kinematics, so that sheets of different lengths, in particular, can be conveyed by the use of identical suction rollers 06 and can be taken over, or passed on with the right alignment.

The front lays 08 on the circumference of the alignment cylinder 04 can preferably be accelerated or braked at a rate of up to +/−0.35 $m/s^2$.

Figure 5:
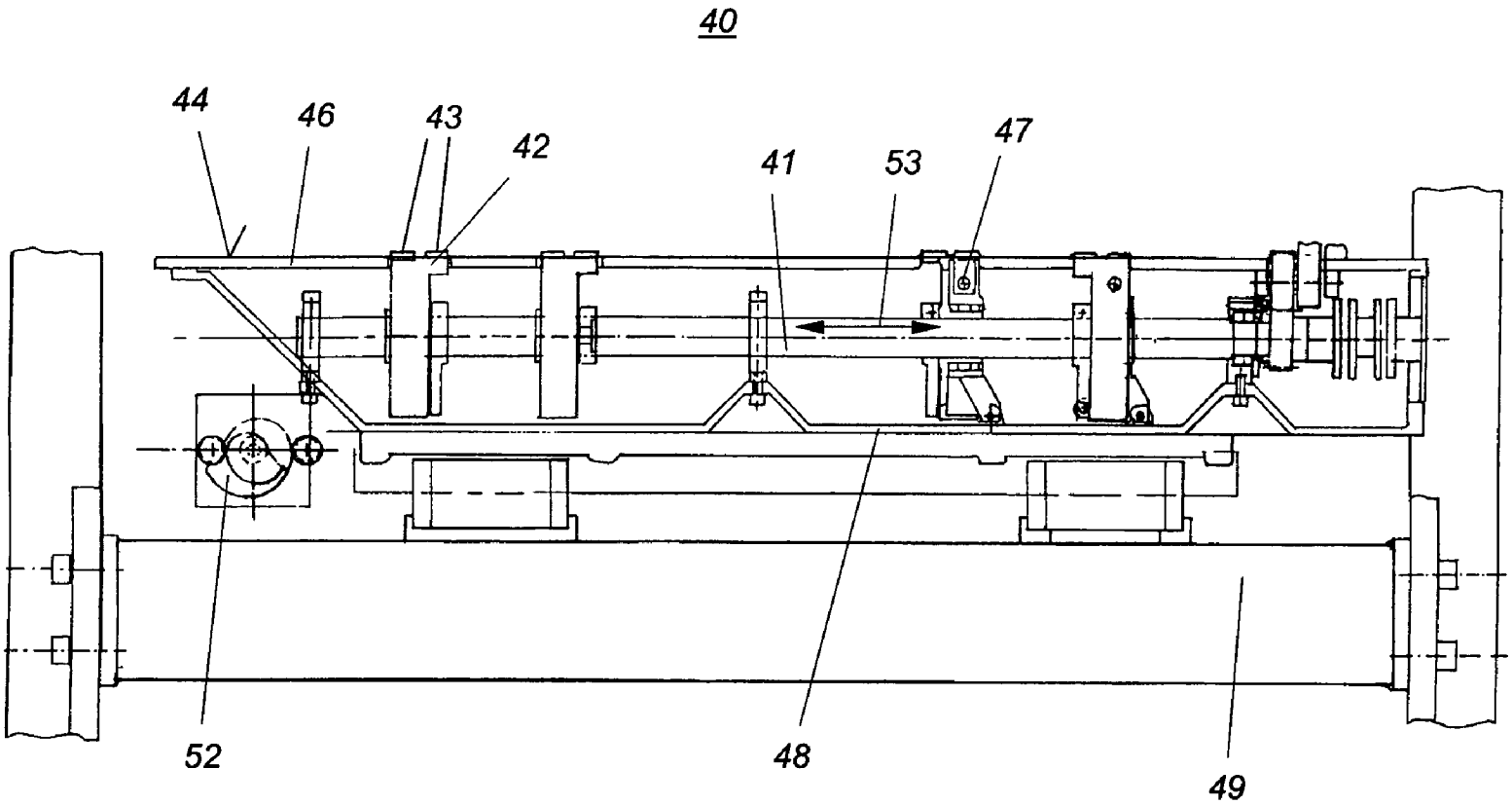
Figure 6:
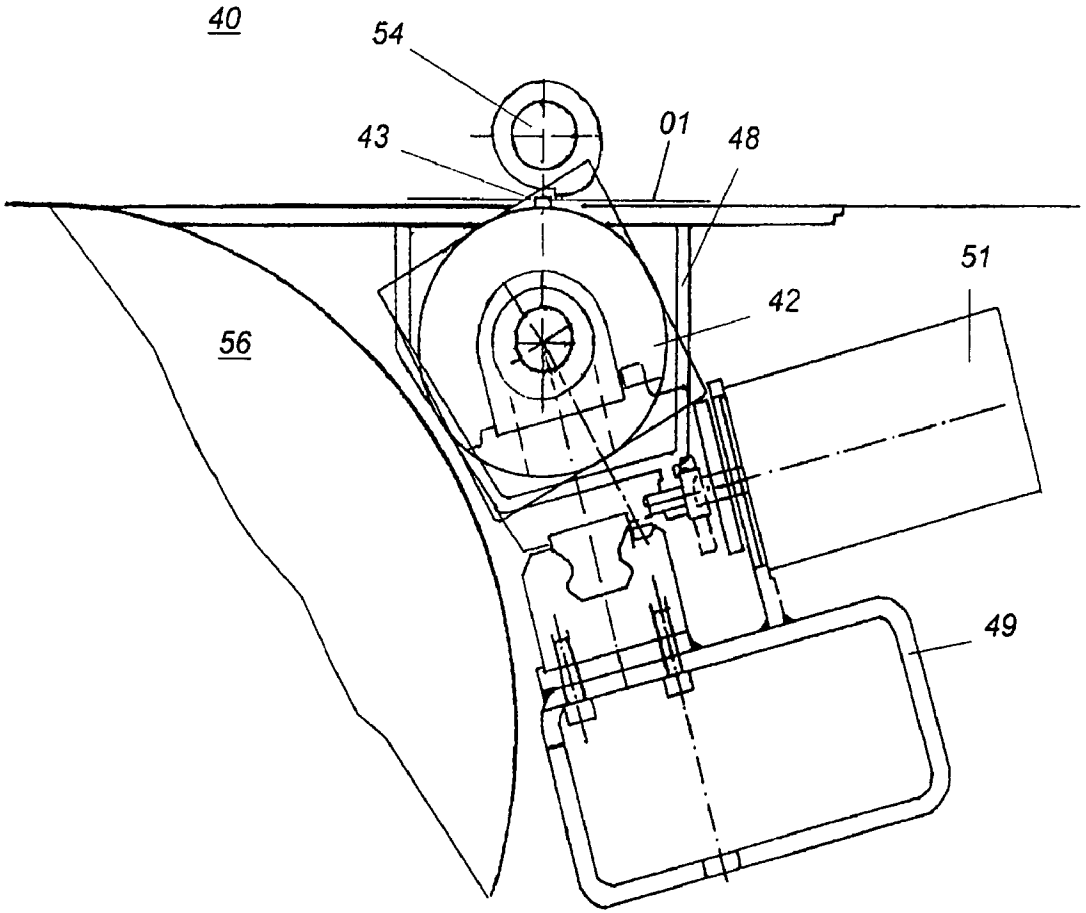

A second preferred embodiment of a device 40 for the alignment of sheets is represented in FIG. 5. A total of four suction rollers 42 are fastened, spaced apart from each other, on a drive shaft 41 which is driven by a drive motor that is, not specifically represented. Two front lays 43, which extend slightly above the surface 44 of the feed table 46 when the drive shaft 41 is in a corresponding position, are arranged on the circumference of each of the suction rollers 42. To be able to frictionally fix the sheets 01, by use of an underpressure or a vacuum, in the course of the sheets being conveyed in the device 40, suction elements 47 are provided on the interior of each of the suction rollers 42, and the suction rollers 42 are stationarily fastened on a first frame element 48. The first frame element 48 is seated, in a manner corresponding to the first device 02, linearly displaceable, on a second frame element 49 and can be driven transversely in respect to the conveying direction of the sheets 01 by operation of a drive motor 51, as seen in FIG. 6, but which is not represented in FIG. 5. The power transmission from the drive motor 51 to the first frame element 48 takes place by use of a cam disk gear 52 shown in FIG. 5, so that the first frame element 48, together with the drive shaft 41, the suction rollers 42, the feed table 46 and a not specifically represented drive motor for the rotational driving of the drive shaft 51, can be linearly driven transversely to the conveying direction of the sheets 01 out of a zero position in the direction shown by the movement arrow 53.

The second embodiment of a device 40 for aligning sheets, in accordance with the present invention, is represented in cross section in FIG. 6. A sheet hold-down roller 54 is arranged above the suction rollers 42, and whose outer circumference is embodied to be helical, so that the gap between the sheet hold-down roller 54 and the suction rollers 42 is reduced or increased as a function of the angle of rotation of the front lays 43. After fixing the sheets 01 in place on the suction rollers 43, and during or after the alignment of the lateral edges of the sheets 01, the sheets 01 are accelerated or braked, by an appropriate driving of the suction rollers 42, in such a way that the sheets 01 can be transferred in correct alignment, to a downstream-located device 56, for example a transfer roller 56.

Figure 7:
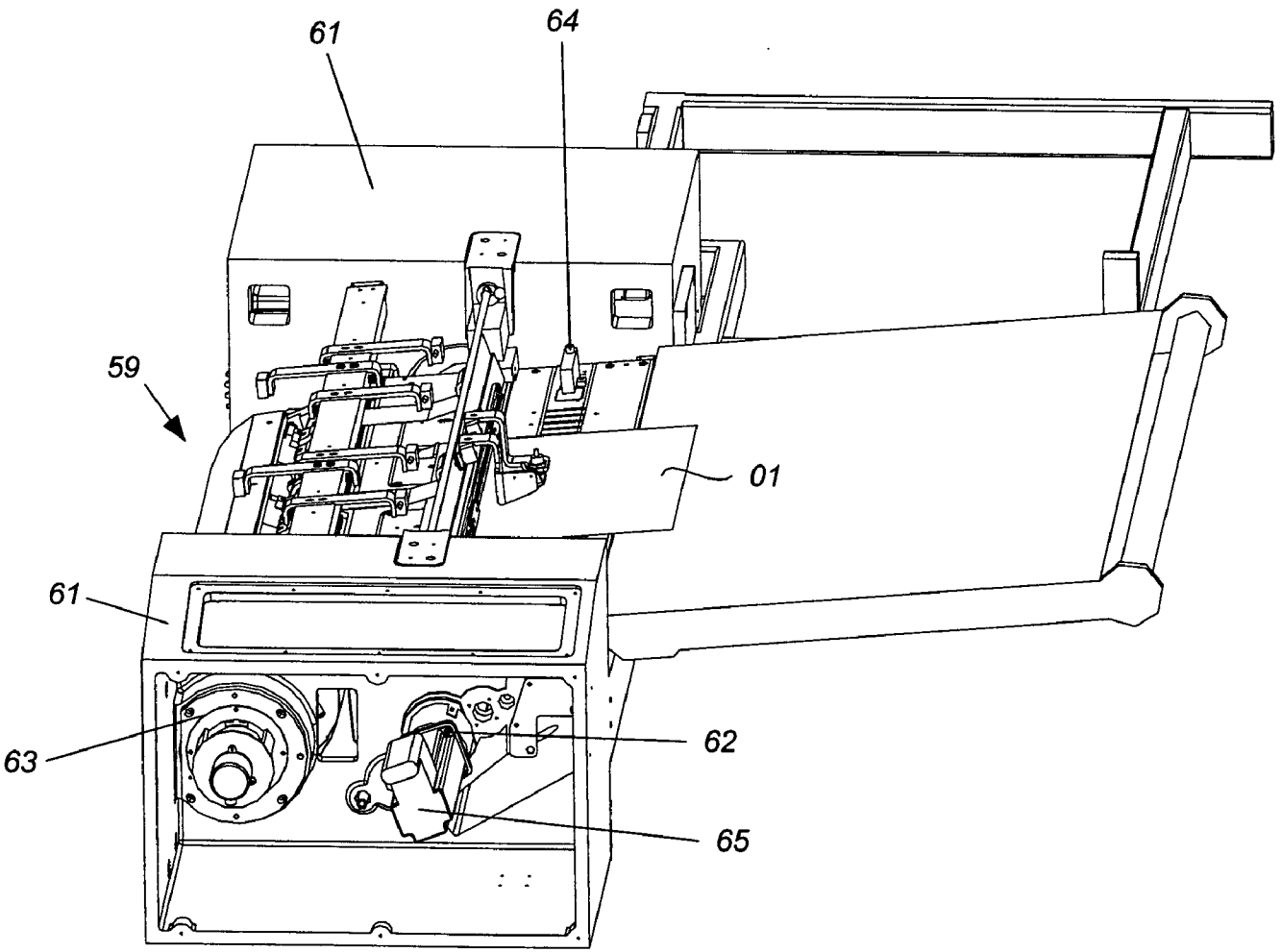

A sheet feeder 59 for use in conveying and aligning sheets 01 and having a device 02, 40 for aligning sheets, in accordance with the present invention, is perspectively represented in FIG. 7. An alignment cylinder 62 and a transfer cylinder 63 are arranged one behind the other in the conveying direction of the sheets 01 in a rack or frame 61. The alignment cylinder 62 can be rotatably driven by a drive motor 65, which can be regulated as a function of its angle. The alignment of the lateral edges of the sheets 01 can be measured by operation of a measuring device 64, for example measuring heads 64, which are arranged on an inlet side of the sheet feeder 59. As a result, the sheet feeder 59 is used for aligning the sheets 01 in respect to their front edge 07 and lateral edge, and for accelerating the sheets 01 in order to be capable of transferring them, depending on their length, in correct alignment to the downstream-located transfer roller 63.

Figure 8:
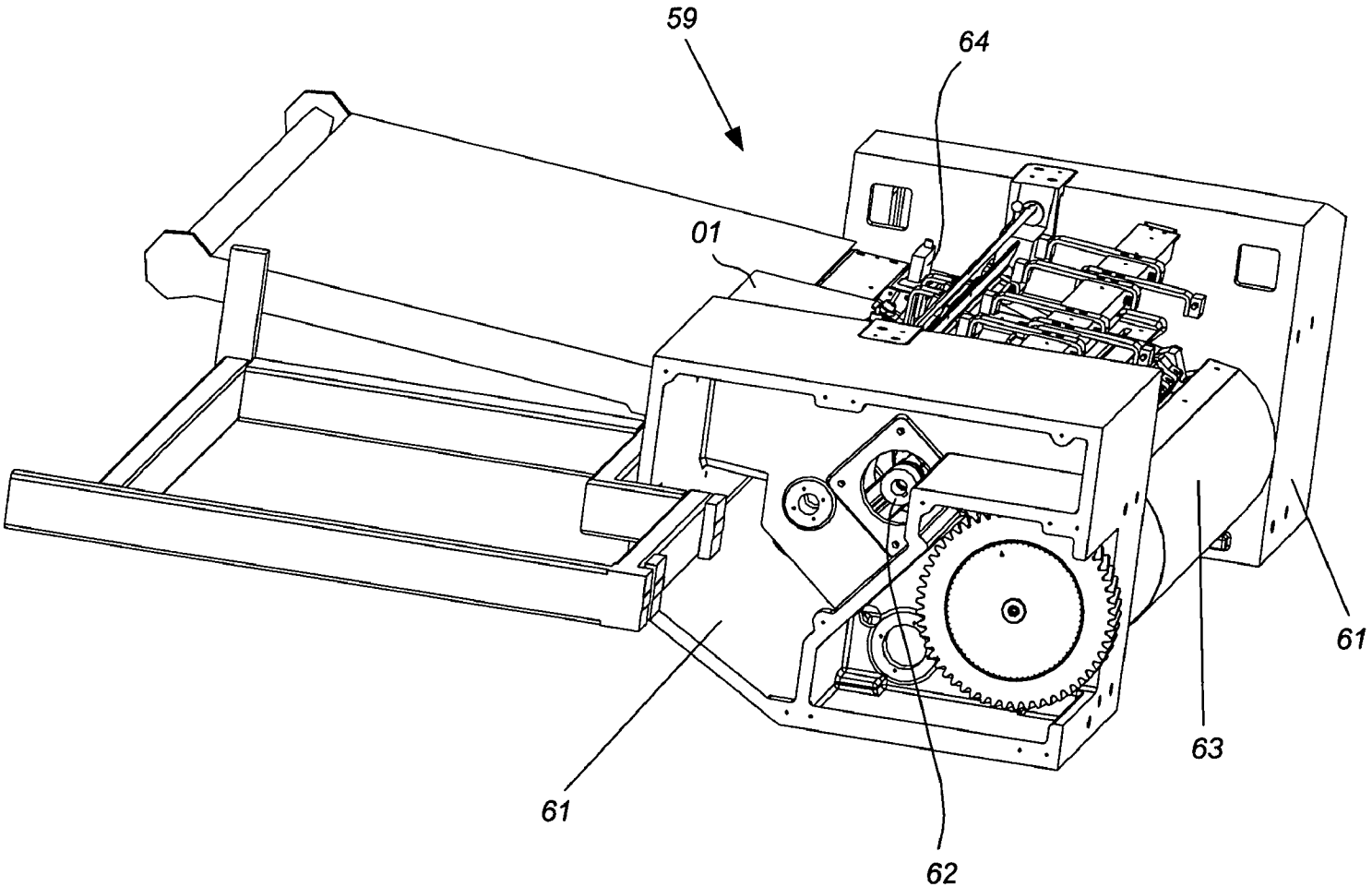

The sheet feeder 59 is perspectively represented from the opposite side in FIG. 8.

Figure 9:
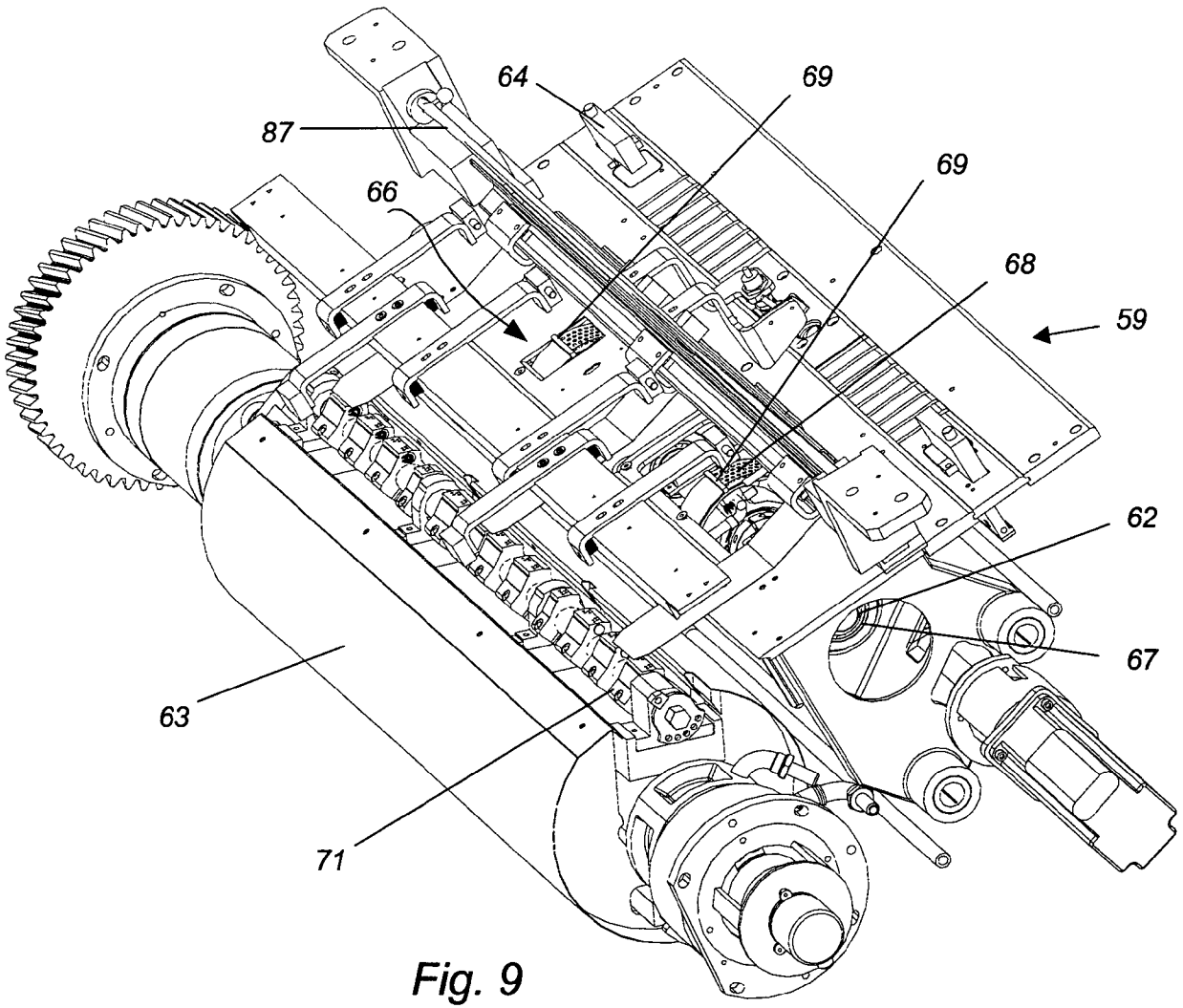
Figure 10:
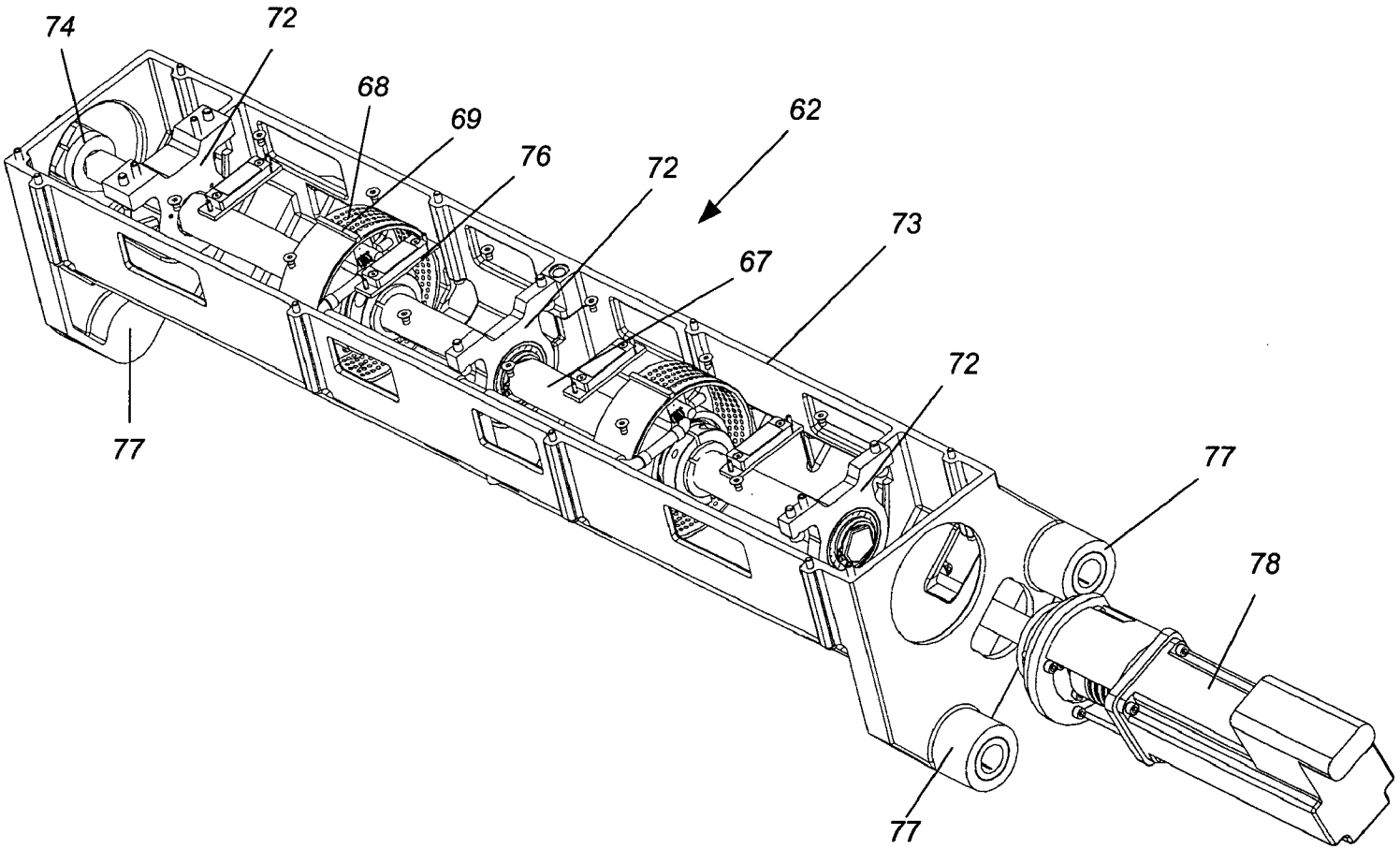

A section through the sheet feeder 59 depicted in FIGS. 7 and 8 is perspectively represented in FIG. 9. The feed table 66, on which the sheets 01 lie flat and are fed to the sheet feeder 59 in an overlapping manner, can be seen. The alignment cylinder 62 is again essentially composed of a drive shaft 67 and two suction rollers 68 fastened on the drive shaft. A plurality of recesses 76, as seen in FIG. 10, are arranged behind each other and next to each other, so that a sheet 01 can be aspirated by use of an underpressure or vacuum for being conveyed on the suction rollers 68. It can be seen in FIGS. 9 and 10 that the recesses 76 start directly behind the front lays 69 and extend in the circumferential direction of the suction rollers 68 and are distributed over an angle of rotation area of approximately 200°. The result of this is that the sheets 01 can be frictionally fastened on the circumference of the suction rollers 68, starting at 0°, which corresponds to the border of the front lay 69, over an angle of rotation of the suction roller 68 of between 130° and 200°. Therefore, no special valve control, for turning the underpressure or vacuum on or off, is required. Instead, an underpressure or vacuum can be permanently applied to the suction chamber, because the sheets 01 are no longer automatically fixed in place on the suction rollers 68 at the time at which the angle of rotation area, which is embodied to be closed, of the suction rollers 68 is located above the suction chamber. The selection of the size of the angle of rotation area with the recesses 76 should be determined as a function of the sheet size to be processed. Holding elements 71 for use in fixing the sheets 01 in place after they have been transferred, are provided on the transfer roller 63, which holding elements 71 fix the front edge of the sheets in place on the transfer roller 63.

The alignment cylinder 62 is represented, removed from the sheet feeder 59, in FIG. 10. The drive shaft 67 is seated, at three bearing points 72, on a first frame element 73 and can be driven rotatingly by a drive motor, which is not specifically represented, arranged at the end 74 of drive shaft 67. The front lays 69 on the suction rollers 68 divide the circumference of the suction rollers 68 into a first area with recesses 76, and a second area without recesses. The first frame element 73 is seated on the rack or frame 61 in sliding sleeves 77 and is linearly displaceable in the direction of the axis of rotation of the drive shaft 67, and can be displaced transversely to the conveying direction of the sheets 01 by the use of a drive motor 78.

Figure 11:
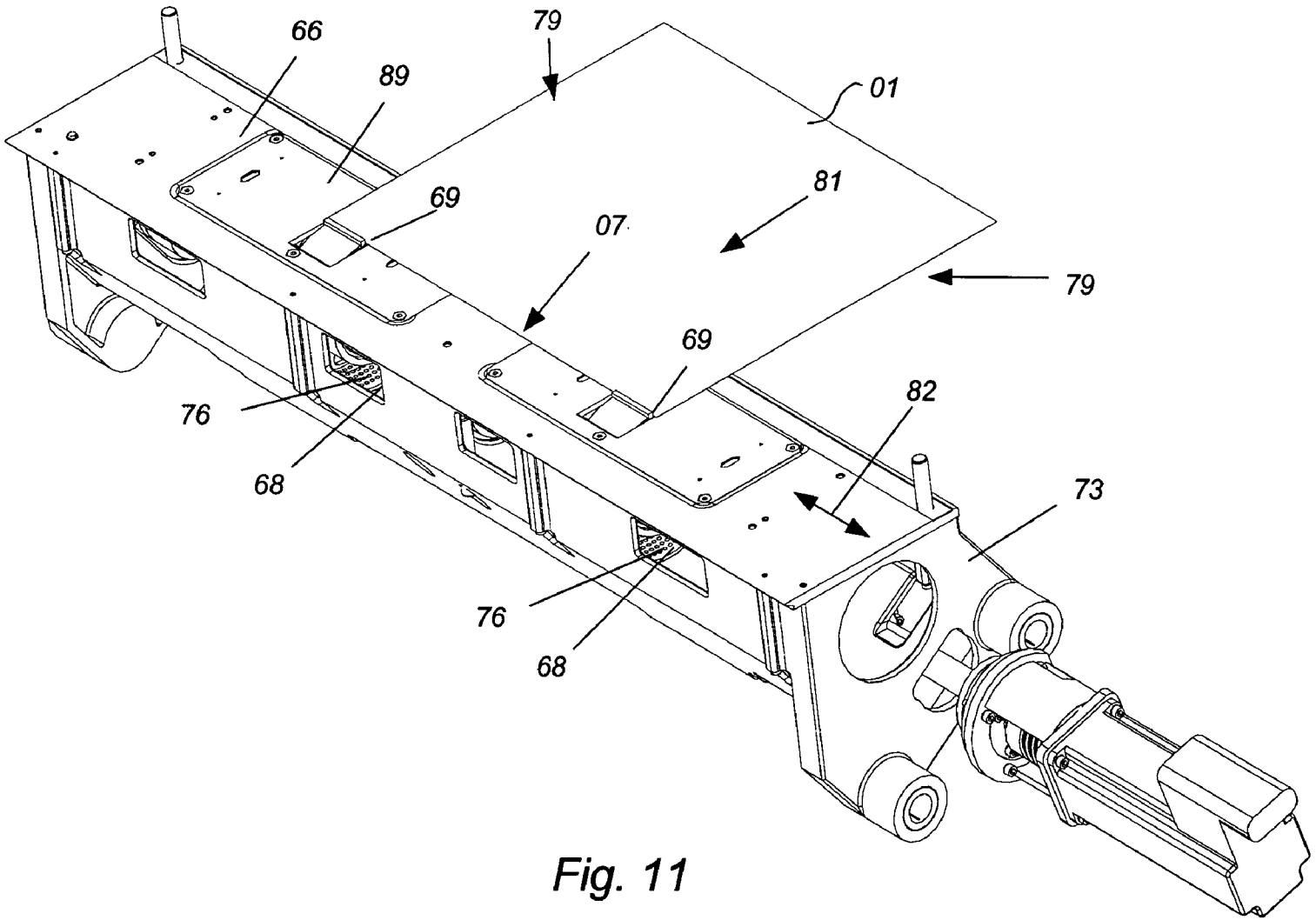

The assignment of a sheet 01 to the alignment cylinder 62, when a sheet feeder 59 is operated, is represented in FIG. 11. First, the front edge 07 of the sheet 01 is aligned at the front lays 69 by the selection of appropriate relative speeds between the front edge 07 and the front lays 69. Thereafter, the sheet 01 is fixed in place in the contact area between the suction rollers 68 and the underside of the sheet in that the recesses 76 reach the area above the suction chamber, which is charged with underpressure or vacuum. After the sheet 01 has been fixed in place, a relative movement transversely to the conveying direction between the sheet 01 and the alignment cylinder 62 is not possible. The entire first frame element 73 can be linearly displaced transversely to the sheet conveying direction 81, in the direction indicated by the movement arrow 82, for aligning one of the lateral edges 79 of the sheet 01.

Figure 12:
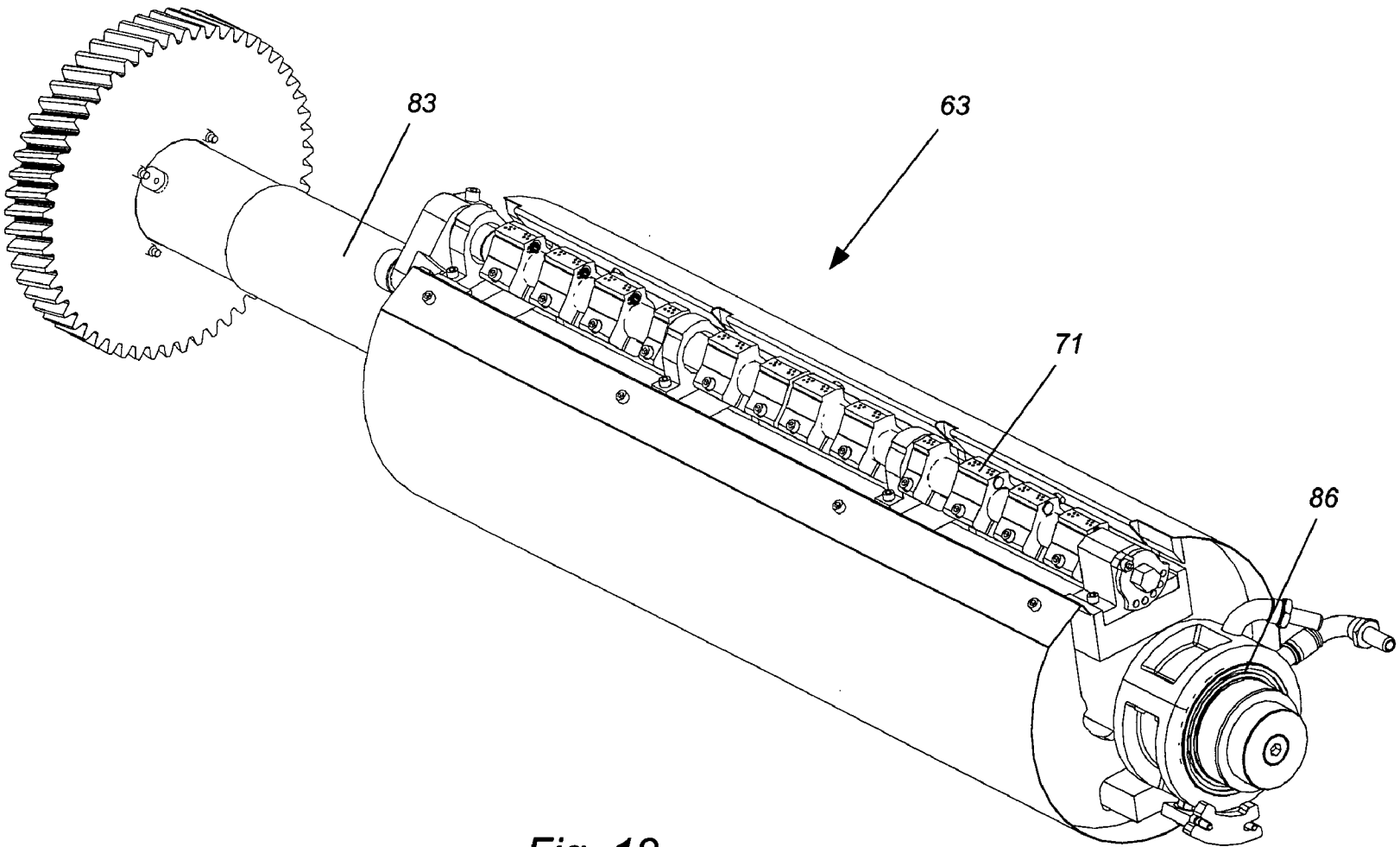

FIG. 12 shows the transfer roller 63 with holding elements 71, a drive shaft 83 and a toothed drive wheel 84. The transfer roller 63 is fastened to the rack 61 on both sides in bearings 86.

Figure 13:
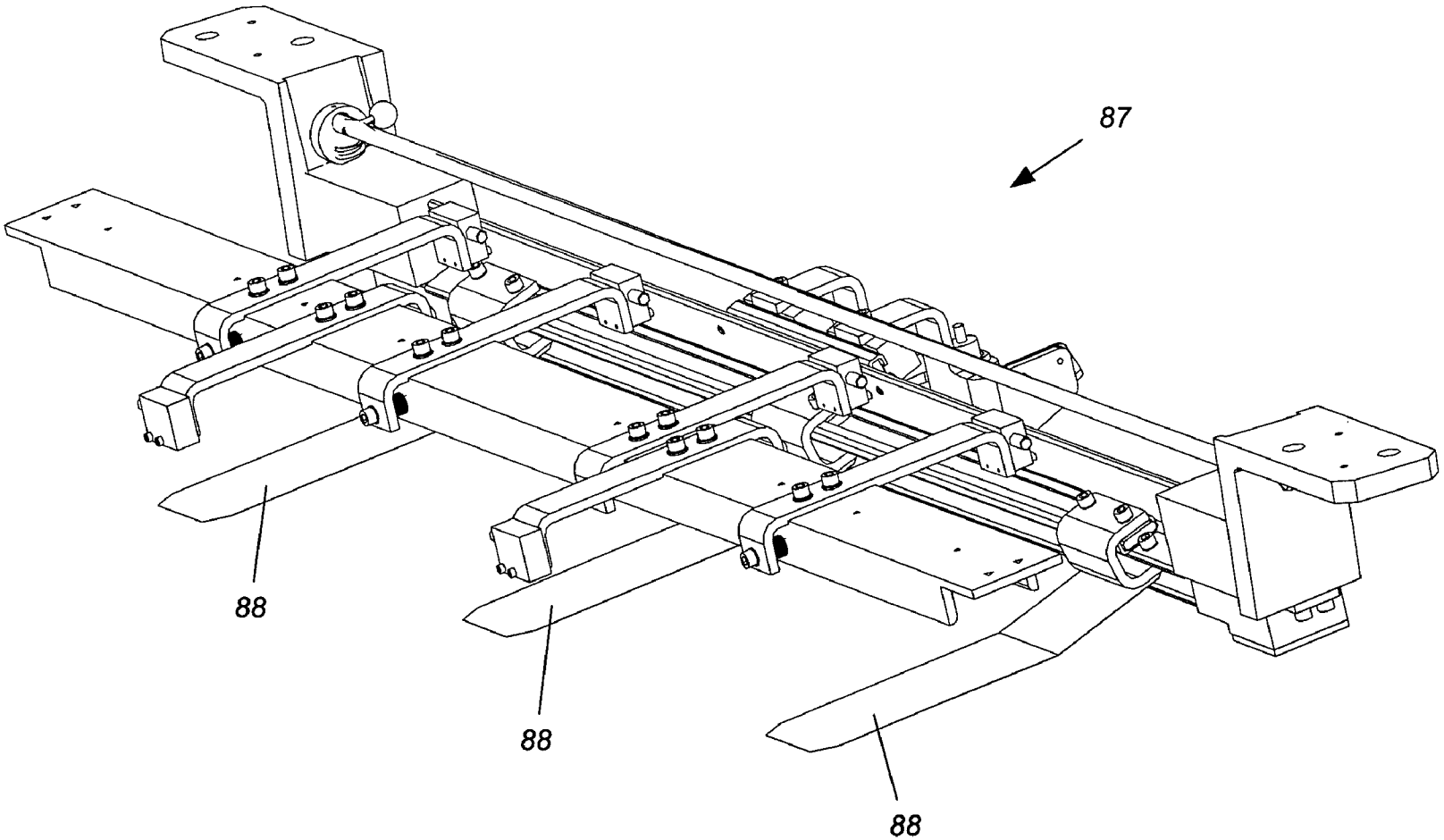

A sheet guidance device 87 for use in the device 59 shown in FIGS. 7–9, is represented by itself in FIG. 13. The maximum distance between the sheets 01 and the surface of the feed table 66 is limited by hold-down plates 88. In this case, the hold-down plates 88 can be oscillatingly lifted or lowered.

Figure 14:
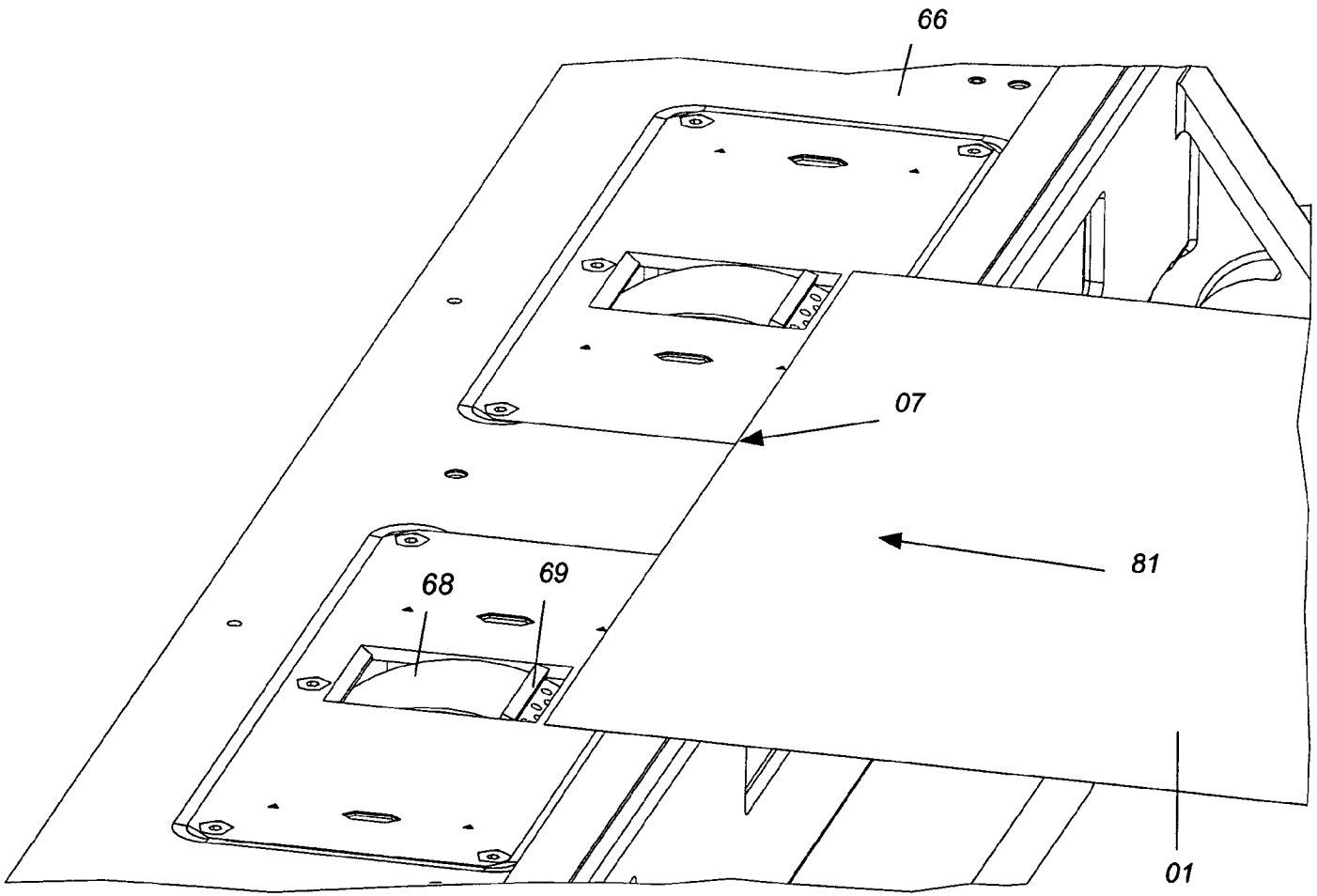
Figure 15:
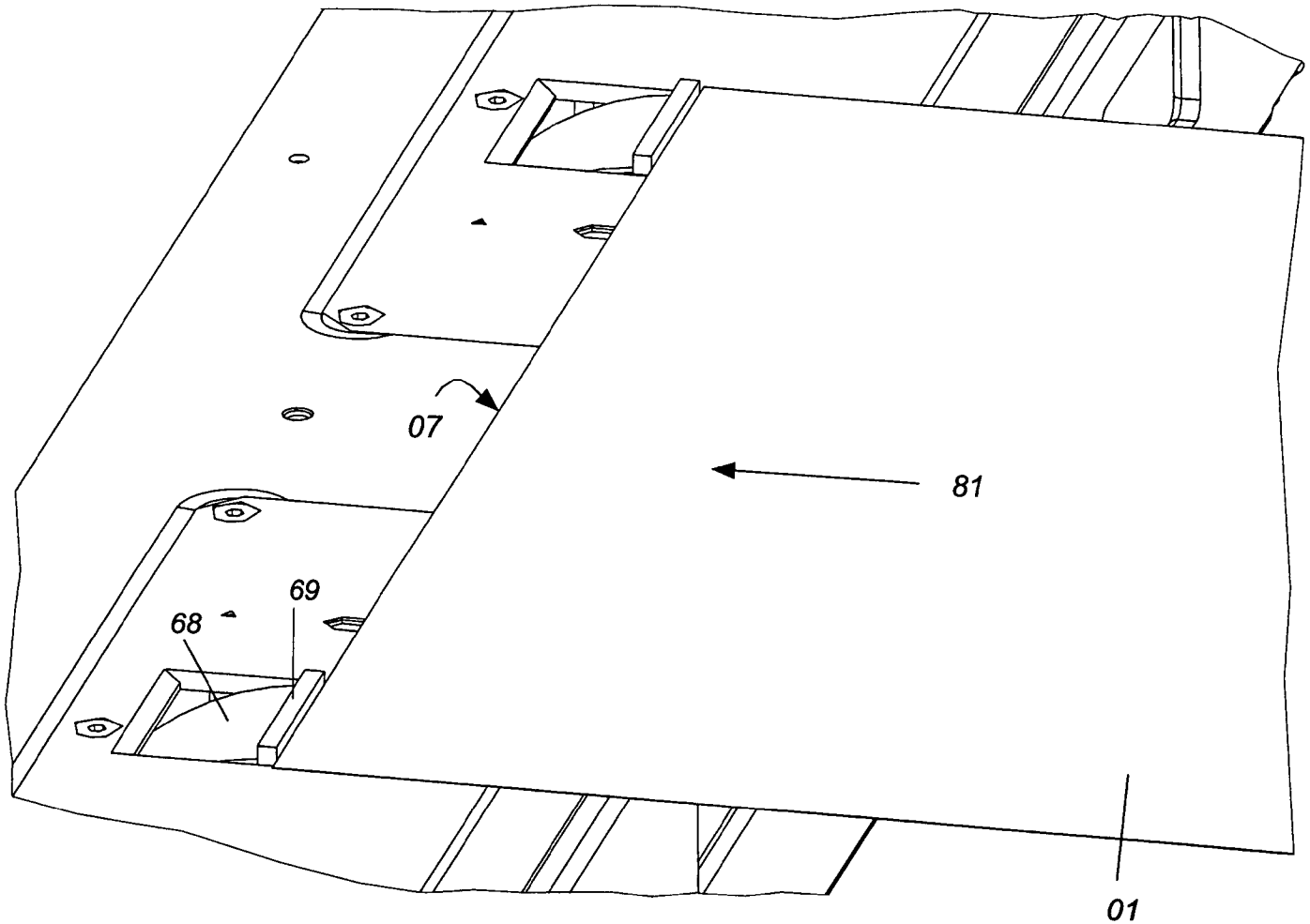
Figure 16:
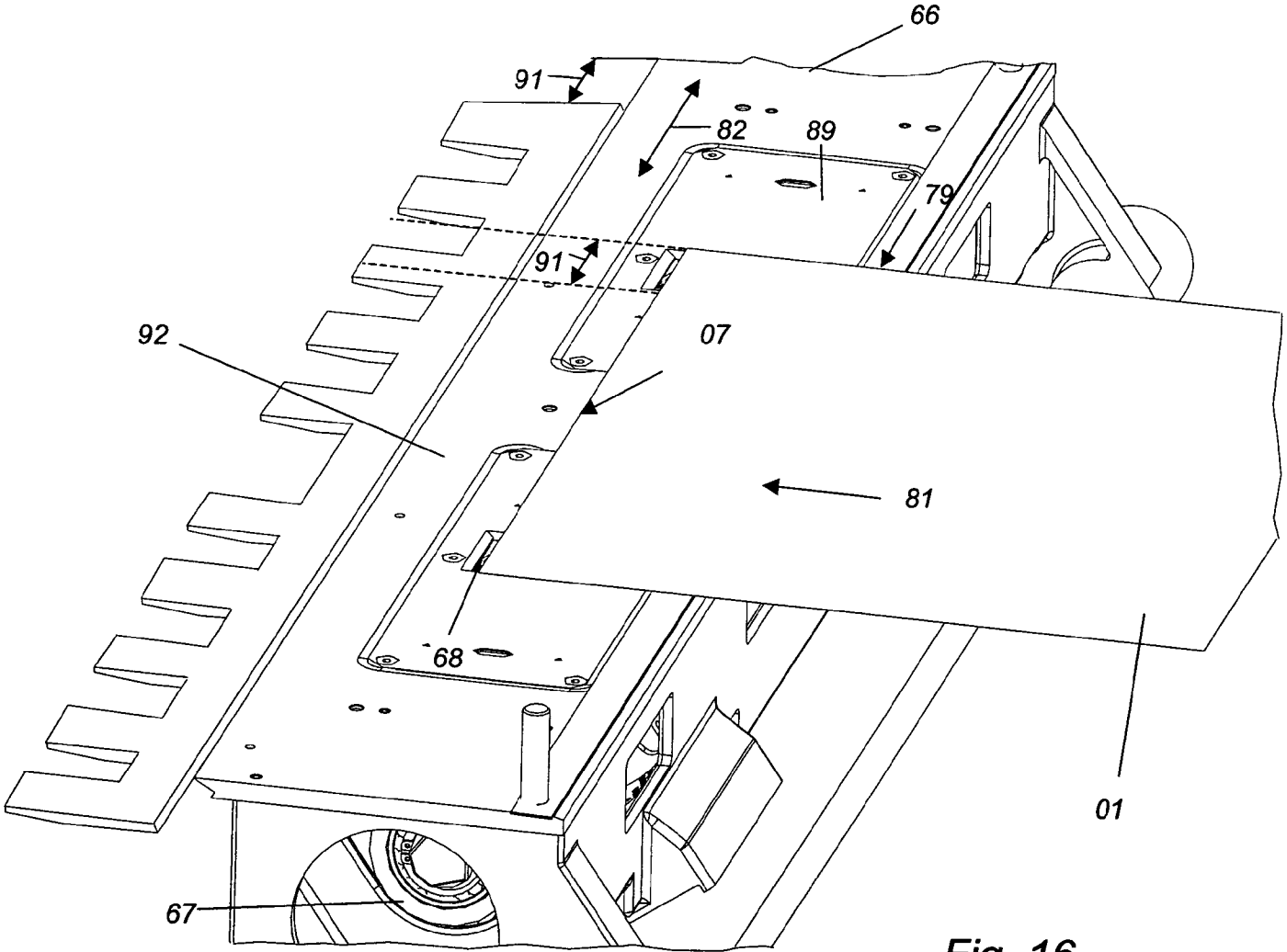

The alignment of a sheet 01, in respect to its front edge 07 and in respect to its right lateral edge 79 and during the various phases of its conveyance on the alignment cylinder 62, is represented in FIGS. 14 to 16.

In the phase represented in FIG. 14, the sheet 01 is conveyed in the conveying direction 81 at a conveying speed which is approximately 20% greater than the circumferential speed of the front lays 69 at the circumference of the suction rollers 68.

Thereafter, and as represented in FIG. 15, the front edge 07 of the sheet 01 comes to rest against the front lays 69 and in the process is braked to the circumferential speed of the suction rollers 68. The front edge 07 is aligned at the front lays 69 within a short time by being braked, without the sheet 01 coming to a stop.

The sheet 01 has now been correctly aligned in respect to its front edge 07. At this time, the recesses 76 at the suction rollers 68, which cannot be seen underneath the sheet 01, reach the area of underpressure or vacuum above the suction elements 47. The sheet is aspirated onto the circumference of the alignment roller 68 and fixed in place by operation of this suction.

Following the alignment of the front edge 07, the sheet 01 is conveyed on in the conveying direction 81 by the continued rotational drive of the suction rollers 68. In the course of their conveyance by the suction rollers 68, the sheets 01 also continue to remain flat on the feed table 66, which is formed by a three-part plate 89 in the area above the suction rollers 68, as seen in FIG. 16. At about this time, the position of the sheet's right lateral edge 79 is measured by the non-represented measuring head 64. At the same time, the motor 78 for driving the drive shaft 67 starts to accelerate in order to bring the sheets 01 up to the desired conveying speed in the conveying direction 81.

Referring again to FIG. 16, the location of the sheet 01, in the course of a next phase of the conveyance, can be seen. It can be seen in FIG. 16 that the sheet front edge 07 has almost reached the rear edge of the plate 89. In order to align the sheet lateral edge 79 in accordance with a desired position, the feed table 66, together with the first frame element 73 located under it, the drive shaft 67 and the suction rollers 66, has been displaced in the direction of the movement arrow 82 transversely in respect to the conveying direction 81 of the sheets 01. The regulating distance 91 by which the sheet 01, together with moved components, was displaced transversely to the conveying direction 81 in the direction of the axis of rotation of the drive shaft 67, can be seen by the edge offset between the feed table 66 and the support surface 92 in the area of the transfer roller 63.

Figure 17:
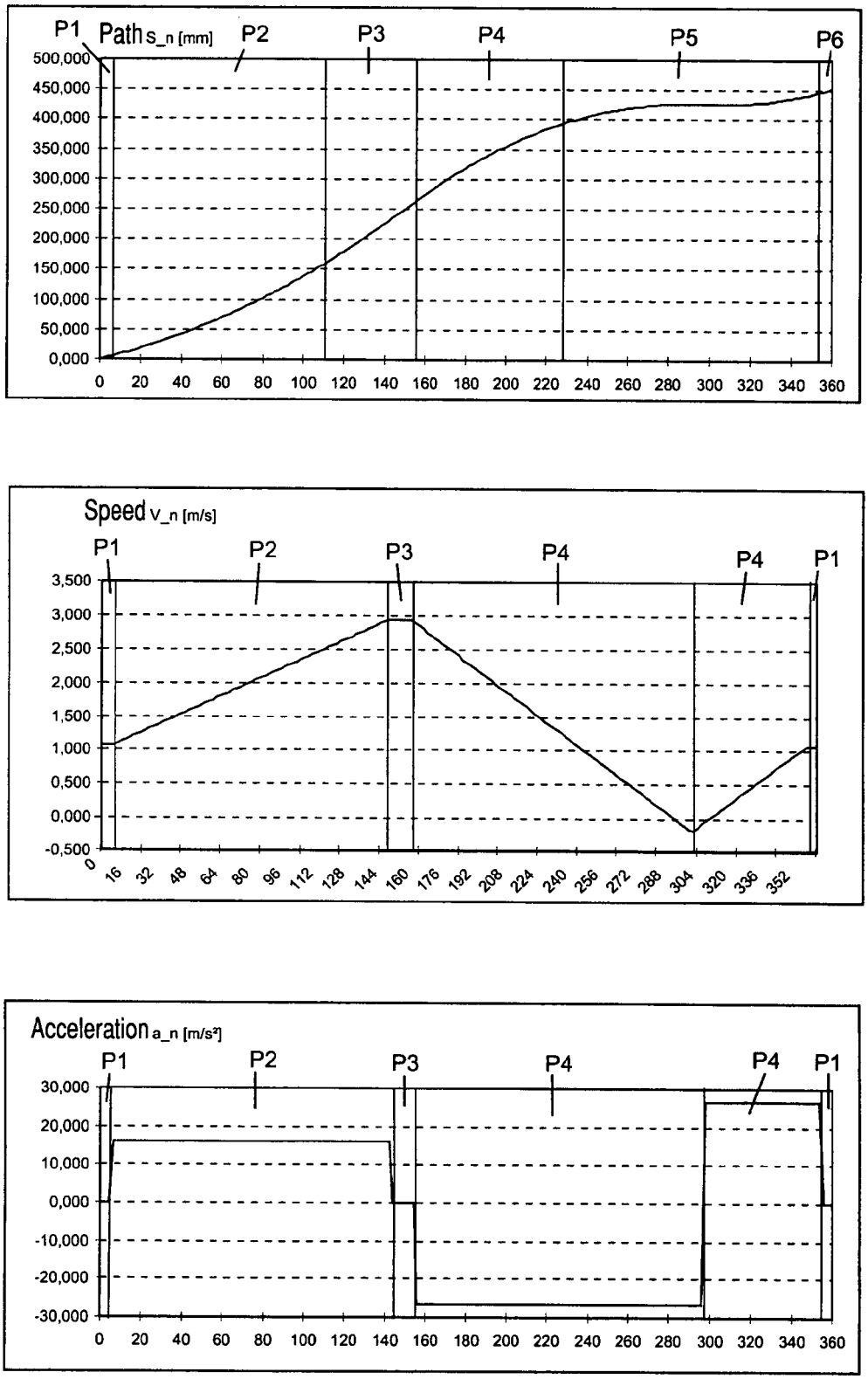

In three diagrams, FIG. 17 depicts the path, speed and acceleration of the suction roller circumference in respect to an angle of rotation. In a first phase P1, the circumferential speed is maintained constant. During this phase P1, the front edges 07 of the sheets 01 come to rest against the front lays 69 and are aligned by means of this. At the end of phase P1, the sheet 01 is correctly aligned in respect to its front edge 07 and is fixed in place on the suction roller 68 by the application of an underpressure or vacuum.

In the following phase P2, the suction rollers 68, and therefore the sheet 01 respectively adhering to them, are accelerated in such a way that, at the time of the sheet transfer to the downstream-located transfer cylinder 63, the sheets 01 have a speed corresponding to the circumferential speed of the transfer cylinder 63. This speed is again maintained constant in phase P3 in order to allow a clean transfer of the sheets 01 to the transfer cylinder 63. As soon as the sheets 01 are fixed in place on the transfer cylinder 63, the sheets 01 are released from the suction roller 68 because no more recesses are provided on the circumference of the suction roller 63 at the corresponding angle of rotation. At approximately the same time of being driven in the conveying direction 81, the sheets 01 are being moved transversely in respect to the conveying direction 81 during phases P2 and P3 for aligning a lateral edge 79 in respect to a desired direction. At the end of phase P3, the sheet 01 has been completely released from the suction rollers 68 and is now driven by the downstream-located transfer cylinder 63. During the subsequent phase P4, the drive shaft 67 must be driven in such a way that the circumferential speed of the suction rollers 68 after a complete revolution, i.e. after 360°, again just corresponds to the feed speed of the sheets 01 out of the device for overlapping, such as the sheet feeder 59. As can be seen from the acceleration, or speed diagram, it may be necessary, to accomplish this, to brake the suction rollers 68 down to the speed zero and to drive them opposite the direction of rotation required for conveying the sheets 01. Departing from the greatest negative acceleration, the suction rollers 68 are then accelerated just enough, so that after a full revolution, the circumferential speed corresponds to the desired circumferential speed for a clean transfer of the sheets 01 from the device for overlapping, such as the sheet feeder 59.

Figure 18:
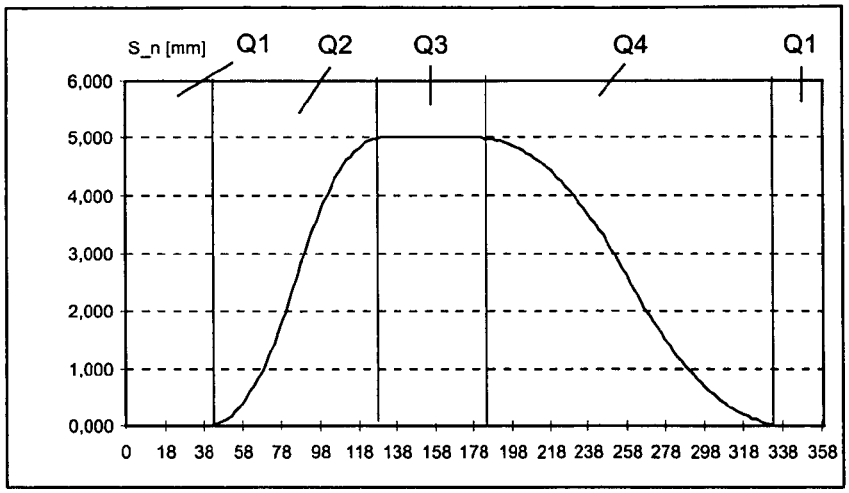
Figure 18:
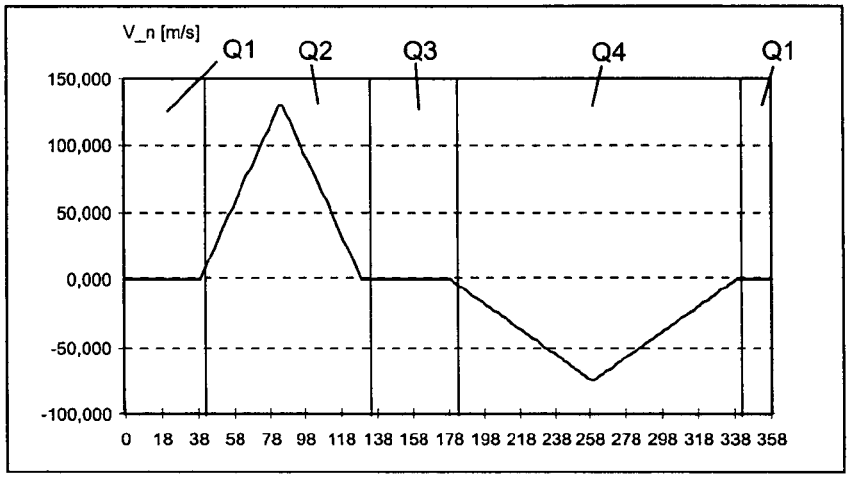
Figure 18:
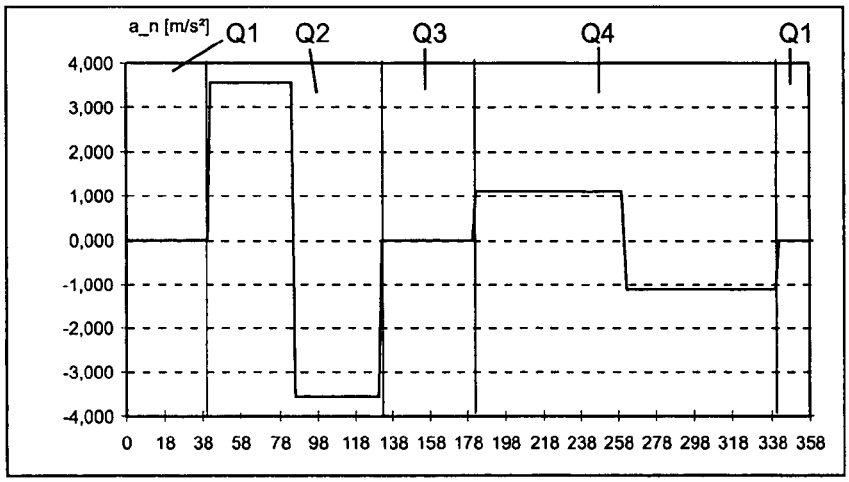

FIG. 18 shows the regulating distance, the speed and the acceleration of the suction roller 68 transversely in respect to the conveying direction 81 during one revolution. In this case, the diagrams are based on a maximum regulating distance of 5 mm, starting at the zero position. No transverse regulating movements are performed during a first phase Q1. In this first phase Q1, the position of the sheet lateral edge 79 to be aligned is measured by the measuring device 64. In the subsequent phase Q2, the suction rollers 68 are accelerated transversely to the conveying direction 81 and are braked again thereafter, until the suction rollers 68 have traveled over a regulating distance of 5 mm, measured transversely to the conveying direction 81 of the sheets 01. At the end of phase Q2, the actual position of the lateral edge 79 to be aligned corresponds to the desired alignment. In phase Q3 which then follows, no further regulating movement of the sheet 01 transversely to the conveying direction of the sheets 01 takes place. In this third phase Q3, the sheets 01 can be transferred without problems to the downstream-arranged transfer cylinder 63. In the following phase Q4, the suction rollers 68, together with the drive shaft 67, are driven in such a way that the zero position has again been achieved no later than after one revolution.

Figure 19:
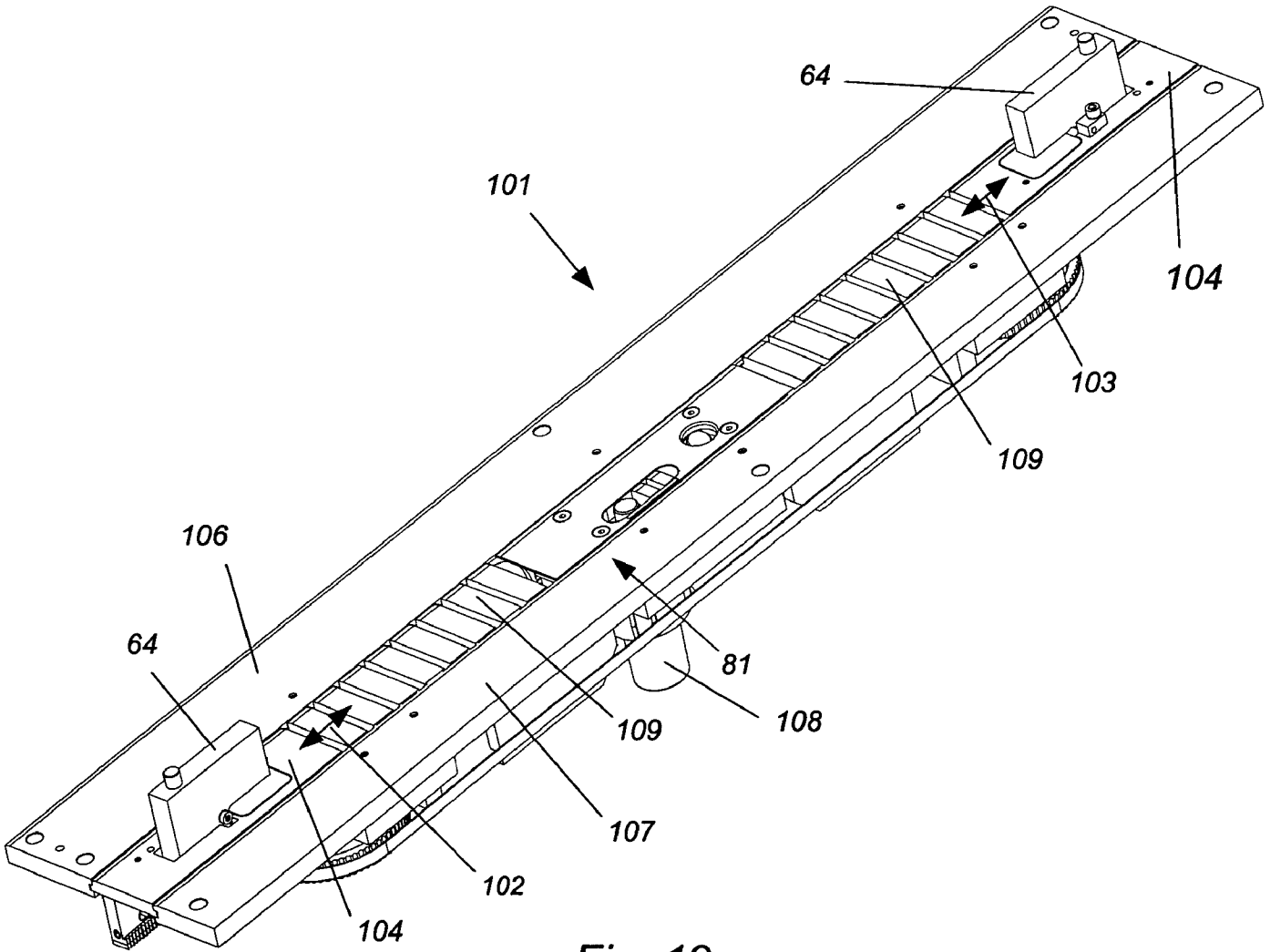

FIG. 19 depicts a device 101 which is usable for measuring the position of the lateral edge 79 of a sheet 01, such as can be used, for example, in a sheet feeder 59 as represented in FIG. 7. Two measuring heads 64 are provided in the device 101, by use of which, the respective position of a lateral edge 79 of a sheet 01 can be determined. A correcting measurement signal, which can be evaluated in an installation control device, is issued by the measuring heads 64 as a function of the position of the lateral edge 79. The lateral edge 79 of the sheet 01 to be measured must be arranged in such a way that the measuring heads 64 are positioned above and below the lateral edge 79. The measurement itself is based on an optical system with the aid of light beams, such as described in EP 0 716 287 A2, for example. Of course any other measuring method or system, and in particular any contactless measuring method or system, can be used. In order to properly arrange the measuring heads 64 when processing sheets 01 of different widths, the measuring heads 64 are seated so that they are linearly displaceable along the position measuring device 101 in the direction indicated by the movement arrows 102 or 103 transversely to the conveying direction 81 of the sheets 01. For this purpose, each of the measuring heads 64 is mounted on a carriage 104, each of which can be displaced in a linear guide, not represented, between the plates 106, 107. In this case, the carriages 104 are driven via a drive arrangement, which is not specifically represented in FIG. 19, by a drive motor 108 that is arranged underneath the plates 106, 107. To make possible a conveyance of the sheets 01 on the surface of the plates 106, 107 which is as interference-free as possible, the gap between the plates 106, 107, which gap is required for the passage of the carriages 104, is closed by a cover element 109. In this case, the surface of the cover elements 109 extends on a level, namely the sheet level, as defined by the resting of the sheets 01 on the plates 106, 107 in a flat, planar fashion.

Figure 20:
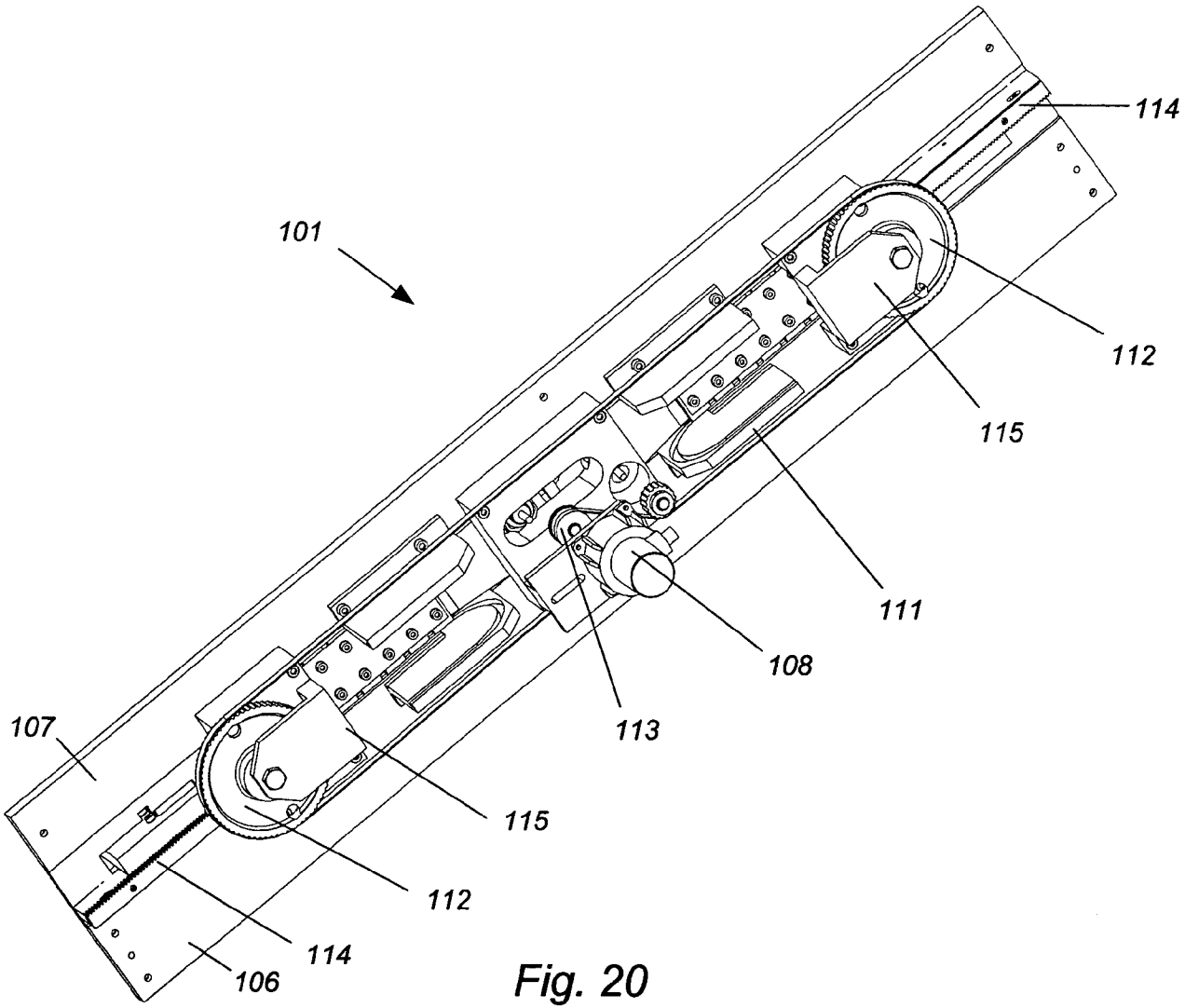
Figure 22:
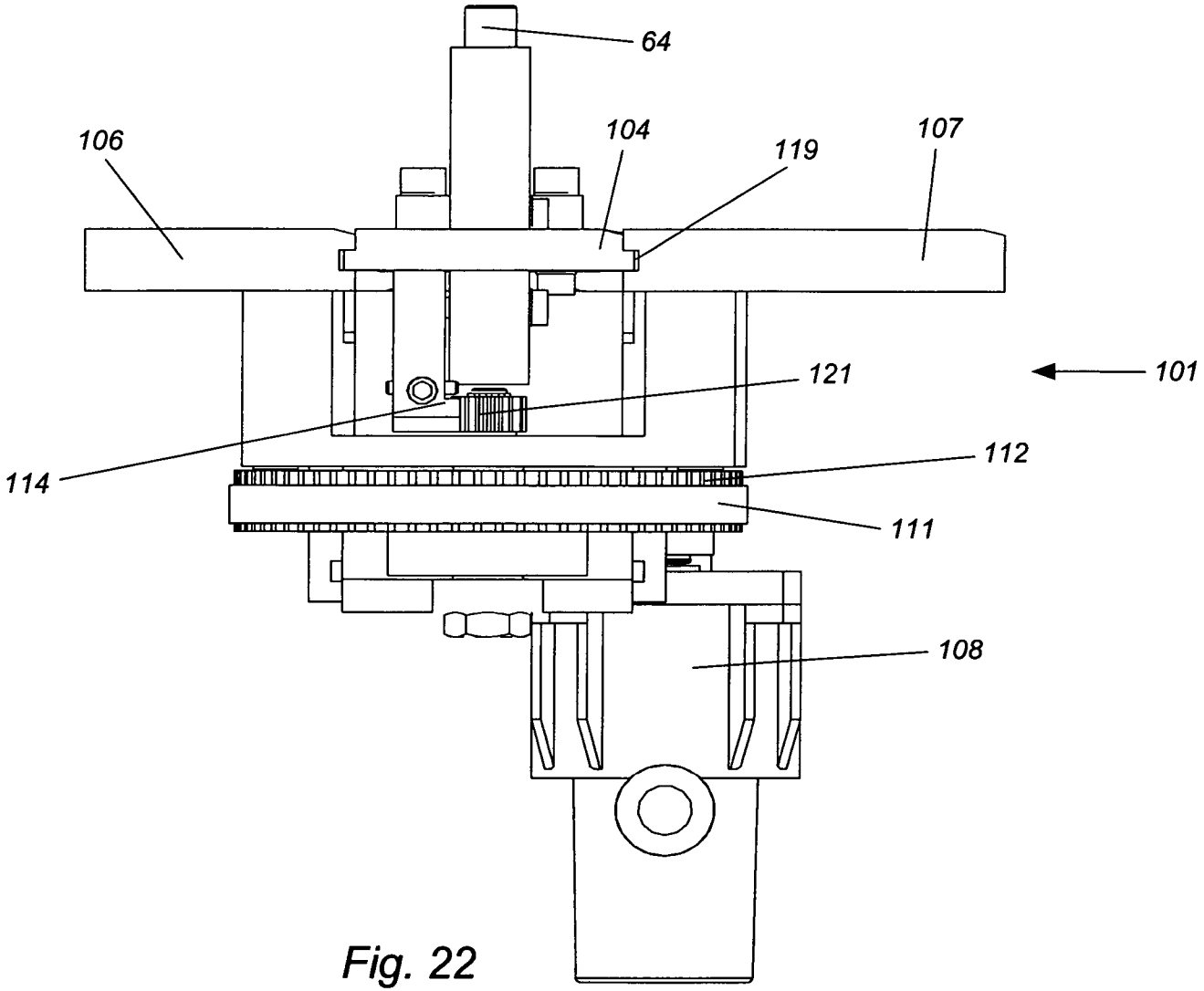

FIG. 20 shows the lateral sheet edge position measured device 101 of FIG. 19 in a perspective view, taken from below. In this case, the drive motor 108 can be seen in particular, which drive motor 108 transfers regulating movements to two drive wheels 112 by use of a toothed belt 111. A tensioning roller 113 is provided for tensioning the toothed belt 111. Two toothed racks 114 are driven by the drive wheels 112 by use of two drive pinions 121, as seen in FIG. 22, which are connected, fixed against relative rotation, with the drive wheels 112, but which drive pinions 121 are not represented in FIG. 20, wherein both toothed racks 114 are each connected with a carriage 104 of a measuring head 64. The drive wheels 112 and the drive pinions 121 connected with them are each fixed in place by a bracket 115 on the frames of the plates 106 or 107.

Figure 21:
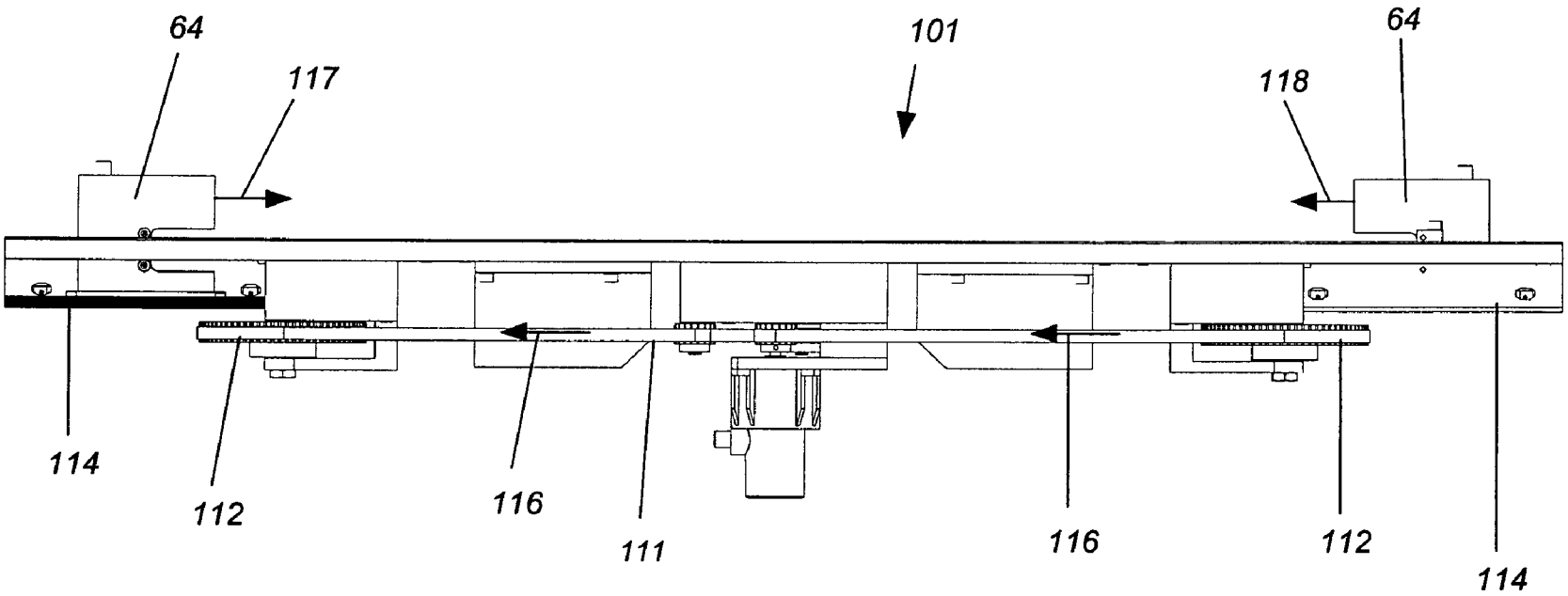

FIG. 21 shows the sheet lateral edge position measuring device 101 in a side view from behind. The toothed racks 114 are fastened to the carriages 104 in such a way that the teeth mesh on respectively opposite sides of the drive pinions 121, which are not represented in FIG. 21. A linear regulating movement of the toothed belt 111, for example in the directions indicated by the movement arrow 116, causes oppositely directed regulating movements of the measuring heads 64 in accordance with the movement arrows 117, 118. Of course the same applies for an opposite regulating movement of the toothed belt 111, because of which, the measuring heads 64 can be moved apart.

FIG. 22 shows the sheet lateral edge position measuring device 101 in a lateral plan view from one side. The carriage 104 is seated on the plates 106, 107 and can be linearly displaced in linear guides 119, which are formed by two grooves. The measuring head 64, which is used as an electronic side marker, is fastened to the surface of the carriage 104. The carriage 104 is driven by the toothed rack 114, whose teeth mesh with a drive pinion 121. The drive pinion 121 is, in turn connected, in a manner so that it is fixed against relative rotation, with the drive wheel 112, which is driven by the drive motor 108 through the toothed belt 111.

Figure 23:
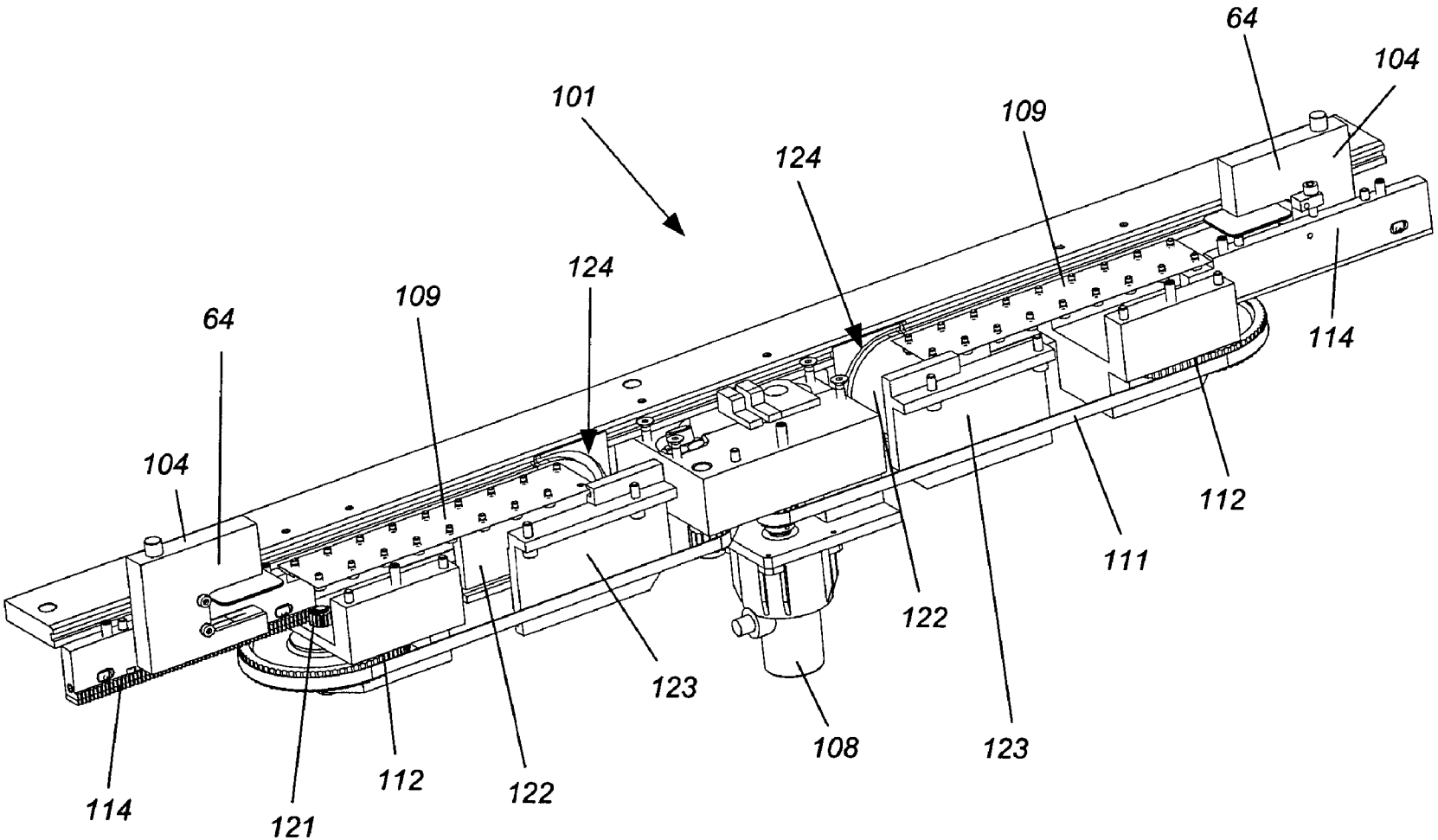

FIG. 23 represents a longitudinal section through the sheet lateral edge position measuring device 101. The drive mechanism for the measuring heads 64 with the drive motor 108, the toothed belt 111, the drive wheels 112, the drive pinion 121 and the laterally spaced, oppositely arranged, toothed racks 114, can be seen once more. Moreover, in FIG. 23 a cover element 109 is represented, one of which cover elements 109 is associated with each of the respective measuring heads 64. The cover elements 109 are embodied as links and are therefore elastically deformable in the direction of their longitudinal axis. An outer end of each of the cover elements 109 is fastened on a carriage 104, so that these cover elements 109 can therefore be moved, together with the measuring head 64, by operating the drive motor 108. If the measuring heads 64 are moved out of their maximally distant position toward each other, it is necessary to deflect the cover elements 109 in a downward direction in sections out of the sheet level in which the flat-lying sheets 01 are conveyed. For this purpose, two holding plates 122, 123 are provided for each of the two cover elements 109 in the device 101, which two holding plates 122, 123 are arranged opposite each other and are used as guide devices for each one of the cover elements 109. Grooves 124 of complementary shape are cut into the inside surfaces of each of the holding plates 122, 123 and extend in the shape of an arc of a circle downward, starting at the straight linear guide 119. In the course of moving the oppositely-located carriages 104 toward each other, the cover elements 109 are downwardly deflected, so that because of this deflector, the cover elements 109 are either shortened or extended, depending on the position of the carriages 104 in the sheet level.

Figure 24:
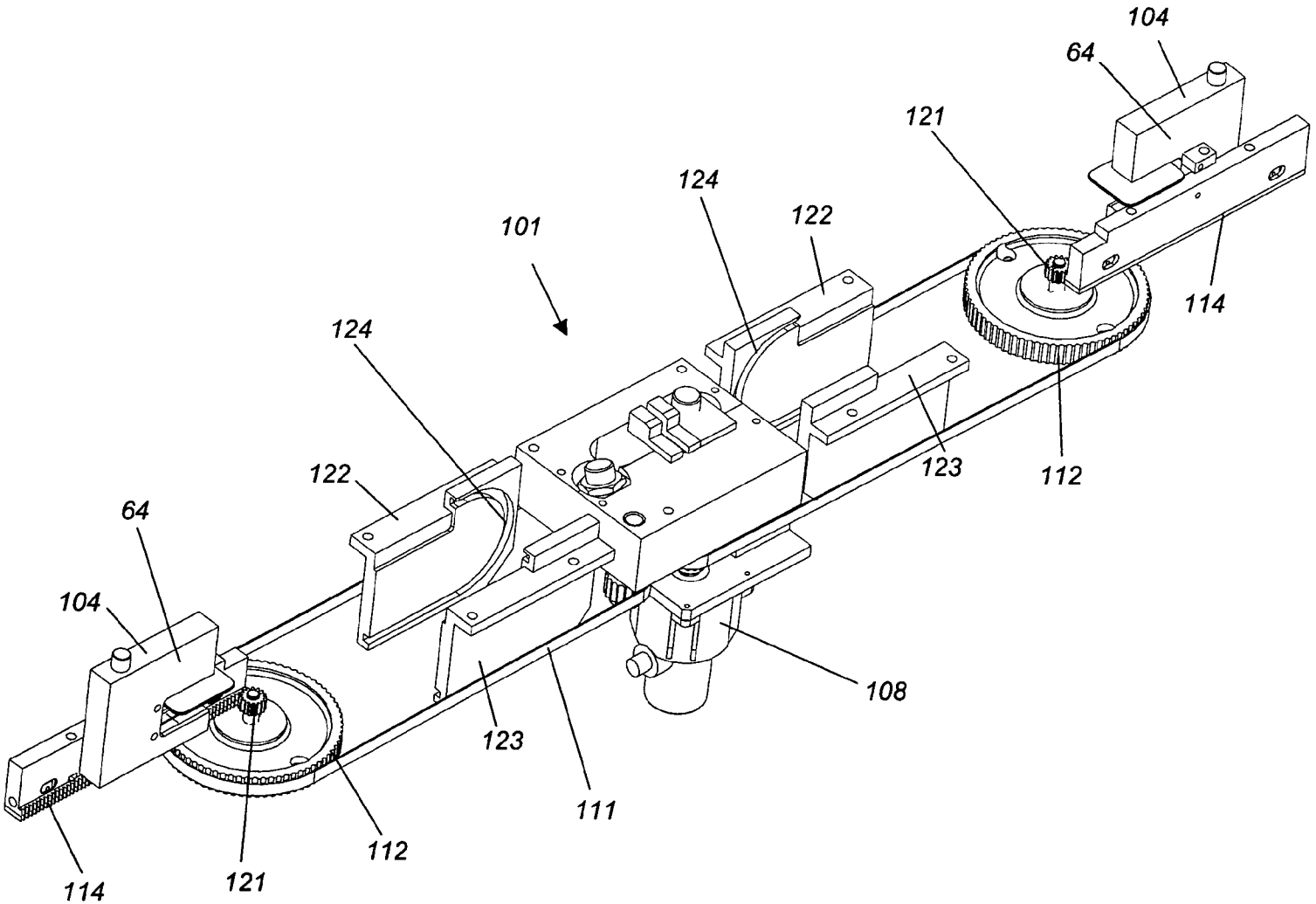

The arrangement for driving the measuring heads 64 by operation of the drive motor 108 is represented without the cover element and without the plates 106 or 107 in FIG. 24.

Figure 25:
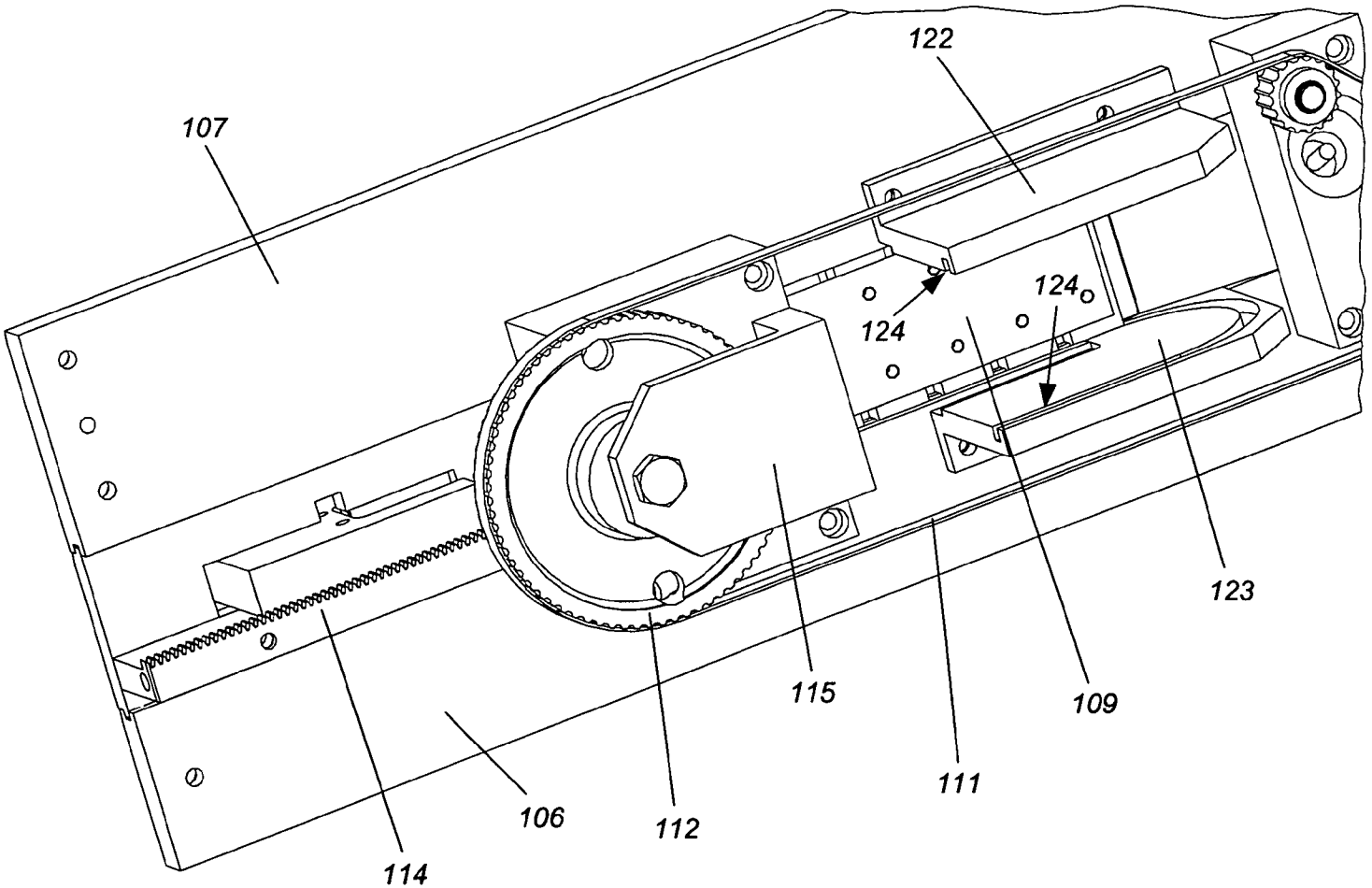
Figure 26:
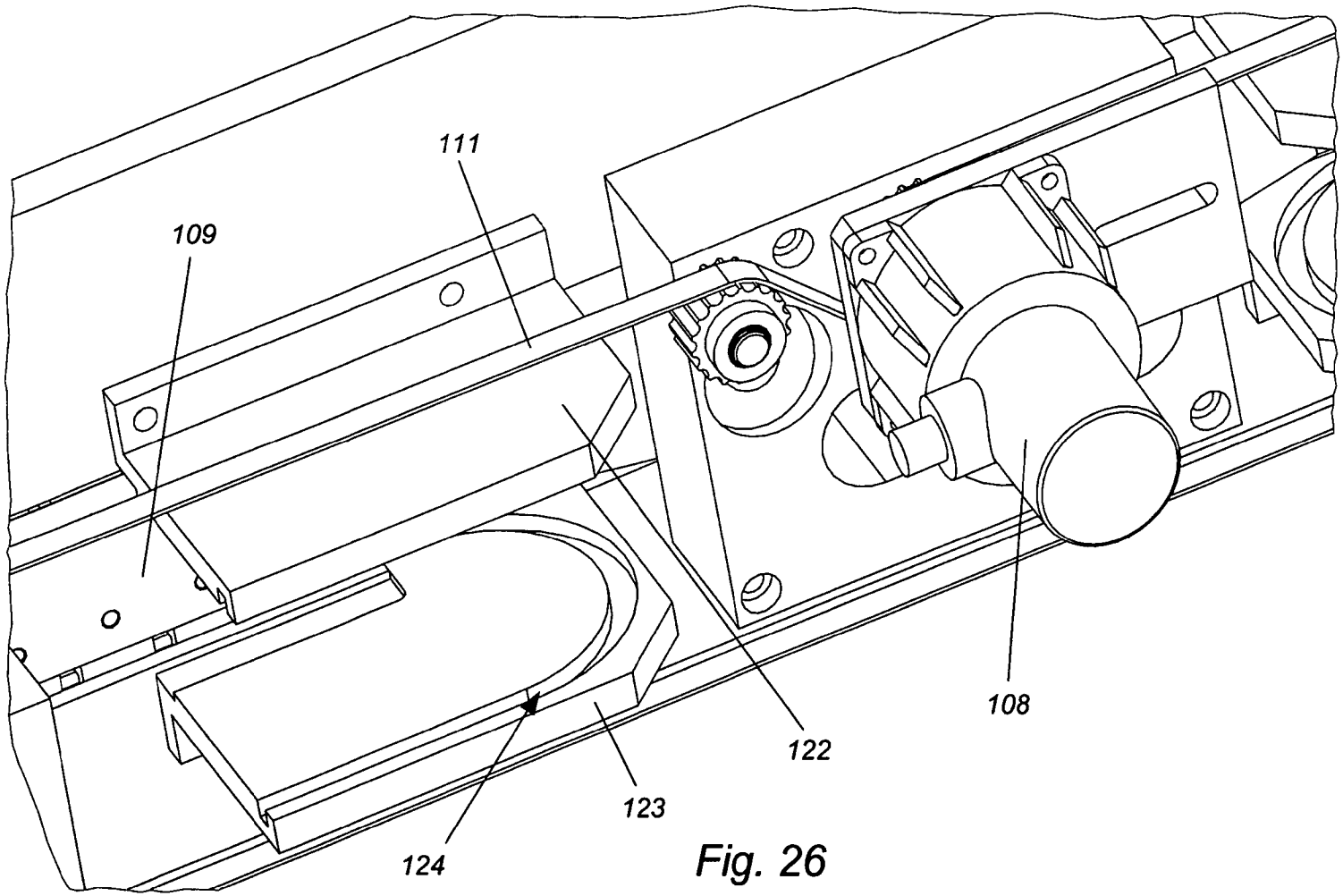
Figure 27:
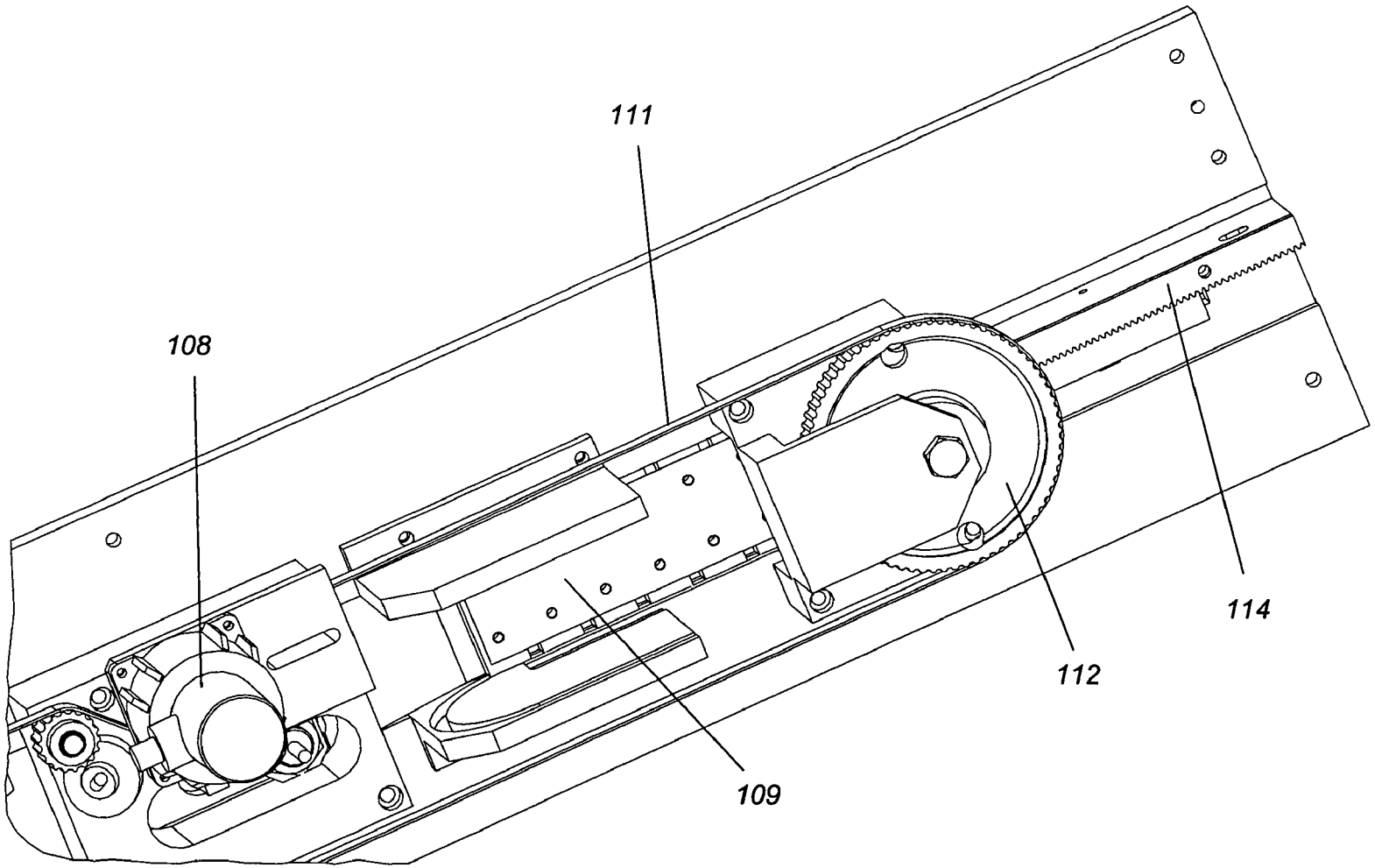

FIGS. 25 to 27 show enlarged portions of the drive mechanism for the carriages 104, or for the measuring heads 64.

A coupling, consisting of coupling elements 130, 131, 144, and which is usable for transmitting a driving torque to an axially adjustable shaft, such as drive shaft 67 shown in FIG. 9, or its essential parts, is represented in FIGS. 28 to 31. Such a coupling 130, 131, 144 can be used, in particular, for transmitting the driving torque from a drive motor to an axially adjustable alignment cylinder of a device for aligning sheet 02, as seen in FIG. 1, a device for aligning sheets 40, as seen in FIG. 4, or a sheet lateral edge position measuring device 101. By employing such a coupling 130, 131, 144 it becomes possible to mount the drive motor for the rotational driving of the alignment cylinder stationarily, so that the mass which must be accelerated in the course of the regulating movement for aligning the sheet lateral edges 79 is reduced.

Figure 28:
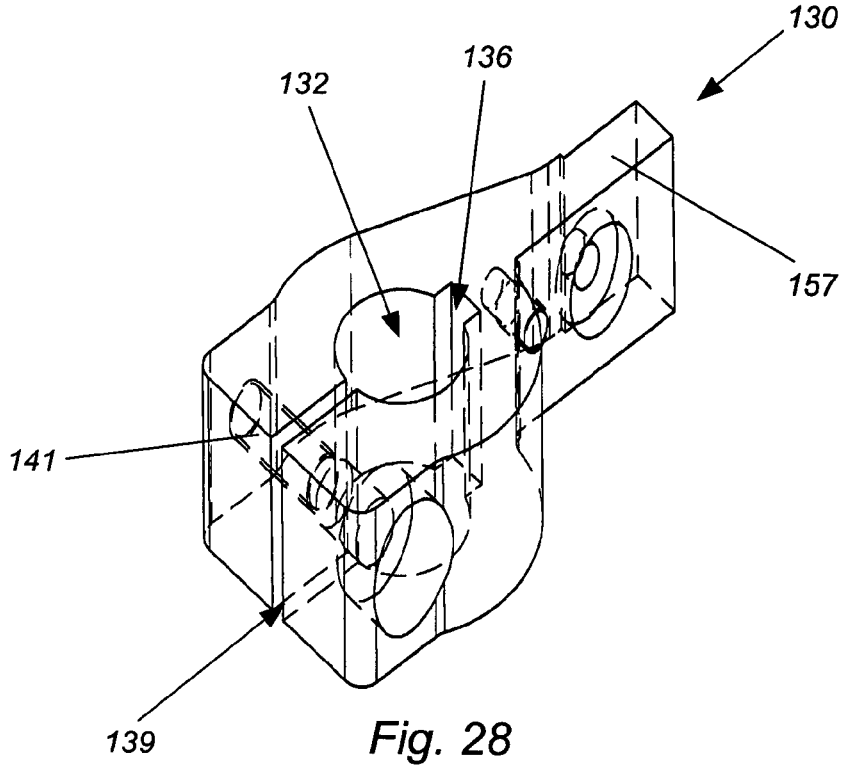
Figure 29:
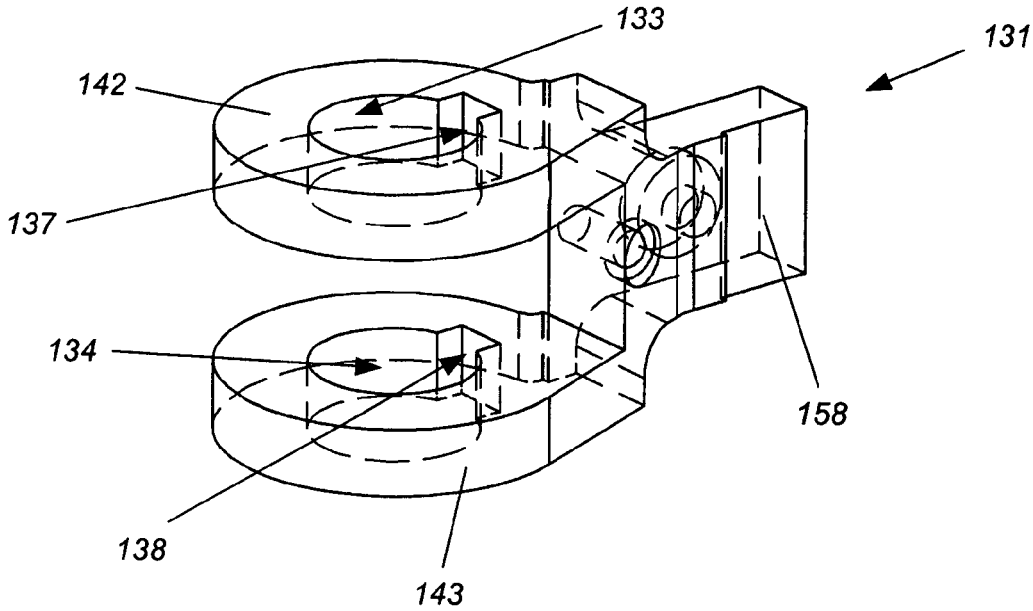
Figure 30:
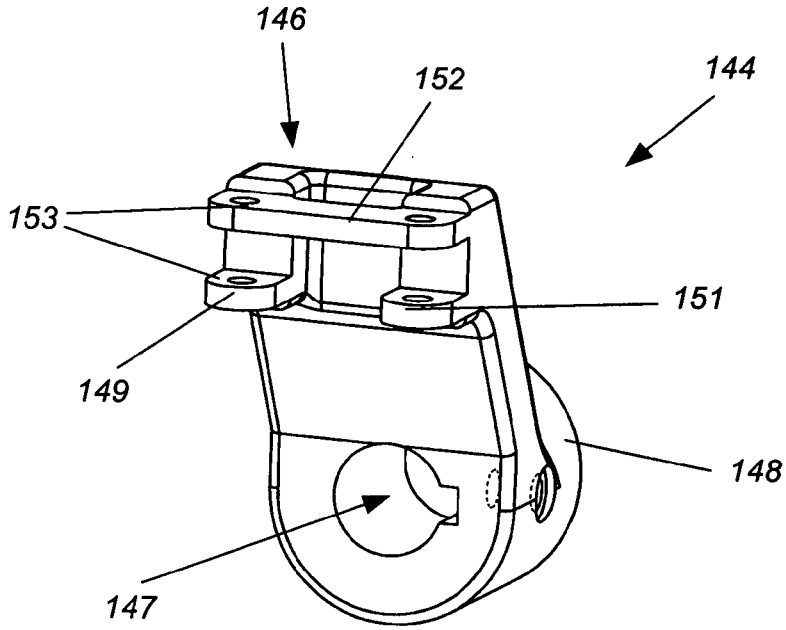

Essentially, the coupling 130, 131, 144 is composed of three coupling elements, which are individually represented in FIGS. 28 to 30, respectively. The first coupling component is composed of two coupling elements 130, as seen in FIGS. 28 and 131, as seen in FIG. 29. Each one of the two coupling elements 130, 131 has recesses or apertures 132, 133, 134, which are each slightly larger than the diameter of the associated shaft 67, for example the drive shaft 67 of the alignment cylinder 62. Feather key grooves 136, 137 and 138 are provided on the inside of each of the recesses or apertures 132, 133, 134, which key grooves 136, 137 and 138 can be brought into engagement with a feather key element, which is not specifically represented, and which is arranged on the drive shaft 67 for transmitting a torque. The first coupling element 130 has a slit 139 for its stationary fixation, so that by tightening a straining screw which is, not specifically represented, in a threaded bore 141, the first coupling element 130 can be frictionally fixed in place on the associated drive shaft 67. As represented in FIG. 29, the end of the second coupling element 131, which is arranged on the associated drive shaft 67, is embodied with two arms 142 and 143, wherein the recesses or apertures 133, 134 are applied aligned with each other on the arms 142 and 143. The distance between the arms 142 and 143 has here been selected to be such that the plate-shaped first coupling element 130 can be arranged, free of axial play, with its end arranged on the drive shaft 67 between the arms 142, 143.

Figure 31:
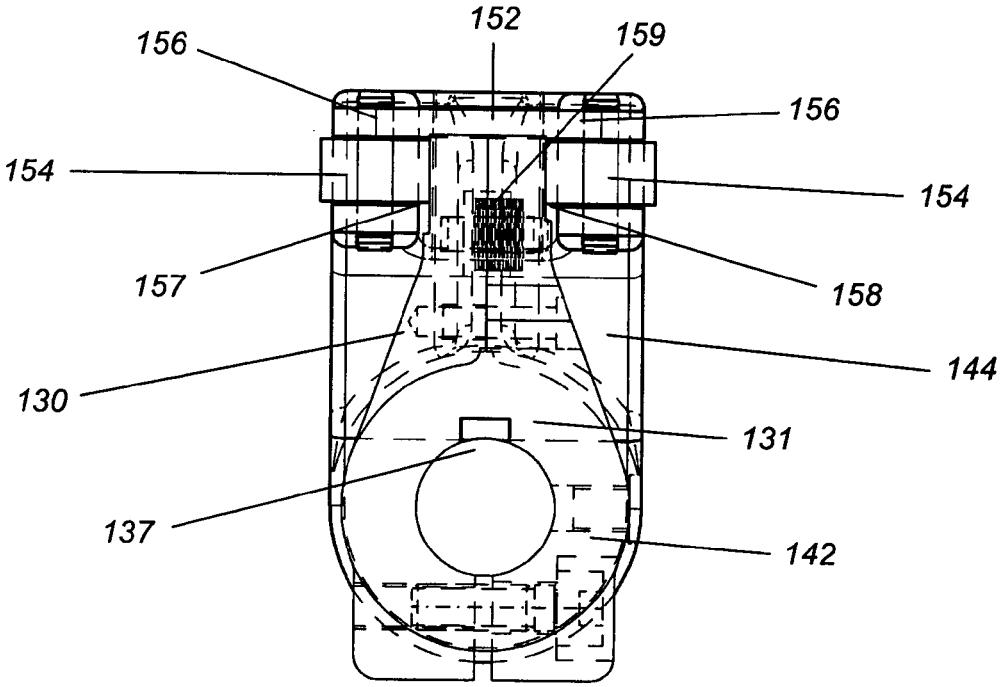

A second coupling component 144 is represented in FIG. 30, and which can work together with the first coupling component 130, 131, that is composed of the coupling elements 130 and 131, during the transmission of a torque. The third coupling element 144 has a bend, so that a radially outer end 146 of the third coupling element 144 projects past an end 147 of an associated shaft 148. The third coupling element 144 is embodied to be fork-shaped on the side of the radially outer end 146 facing the first coupling component 130, 131, and extends with two arms 149 and 151 in the direction of the first coupling component 130, 131. Axial bearings 153, in which the pivots of rolling bodies 154, as seen in FIG. 31, can be fastened, are attached to each of the arms 149 and 151 and also to an oppositely located counter-bearing 152. In this case, the axial bearings 153 are arranged in such a way that pivots 156 extend parallel with outside portions 157, 158 of the coupling elements 130, 131, which come into engagement with the rolling bodies 154.

Functioning of the coupling 130, 131, 144, comprised of the second coupling component 144 and the first coupling component 130, 131, put together from the coupling elements 130 and 131, is explained by reference to FIG. 31. After installation of the coupling elements 130 and 131 at the one shaft end, and of the third coupling element 144 at the oppositely located shaft end, the outsides 157, 158 of the coupling elements 130, 131 rest against the inside of the rolling bodies 154. By tightening the straining screw at the coupling element 130, the coupling element 130 is fixed in place and fixes the coupling element 131 axially on the shaft end because of its arrangement between the arms 142 and 143. The feather key grooves 137, 138 of the second coupling element 131 are made slightly wider than the feather key element of the drive shaft 67, so that the second coupling element 131 can be slightly turned on the drive shaft 67. A spring element 159, which elastically braces the coupling element 131 against the coupling element 130 and which spreads the two coupling elements 130 or 131 open, is arranged between the radially outer ends 146 of the coupling elements 130, 131. A resilient, free-of-play seating of the outsides 157 or 158 at the rolling bodies 154 is assured at any time by this arrangement.

If now a torque is applied to the drive shaft 67, or to one of the oppositely located drive shafts 67, the torque is transmitted by a positive connection between the rolling bodies 154 and the outer ends of the coupling elements 130 and 131. A deflection of the coupling 130, 131, 144, in particular in the course of frequent changes of the direction of rotation, is prevented to a large extent because of the elastic bracing of the two coupling elements 130 and 131.

If the drive shaft 67, or one of the drive shafts 67, is axially displaced in the direction of its axis of rotation in respect to the opposite shaft, the outsides 157, 158 roll off on the rolling bodies 154, so that an axial displacement, even under a load, is possible essentially free of resistance.

Figure 32:
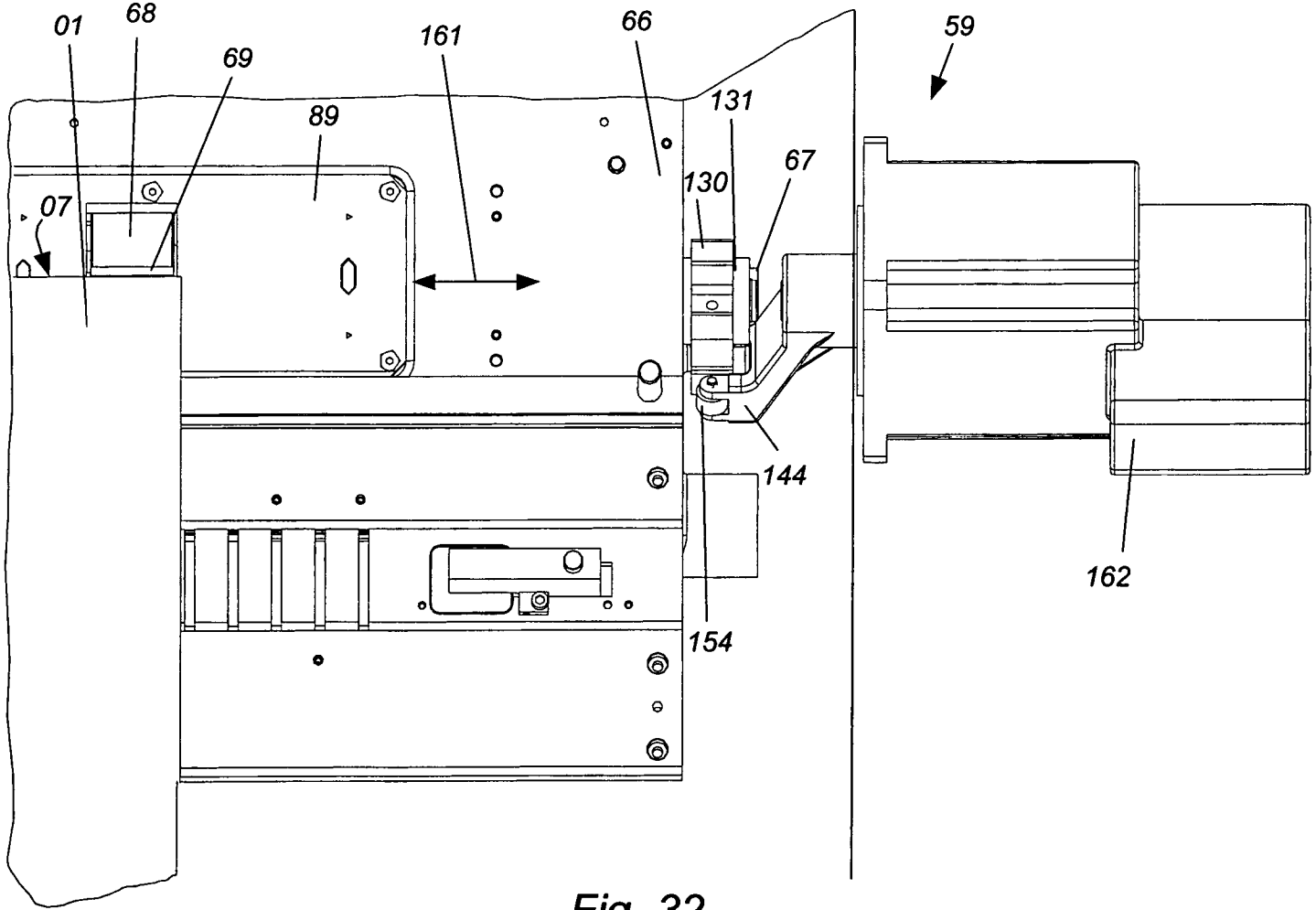
Figure 33:
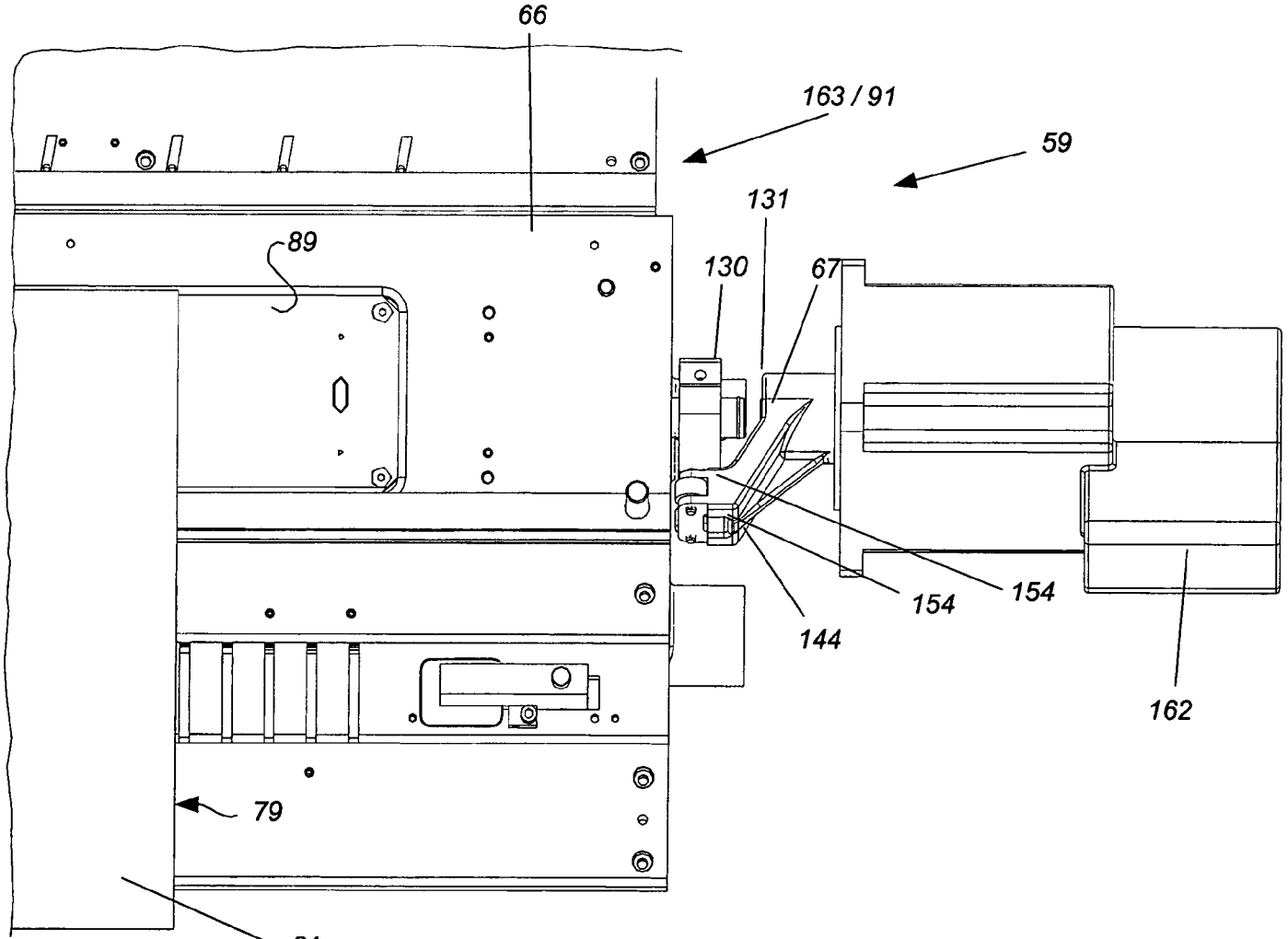

The employment of a coupling 130, 131, 144 with the coupling elements 130 and 131, as well as the third coupling element 144, in a sheet feeder 59 is represented in a view from above in FIGS. 32 and 33.

In the phase represented in FIG. 32, a sheet 01 has just arrived at the front lays 69 on the suction rollers 68, so that the front edge 07 of the sheet 01 is aligned. In this phase, the feed table 66 which, together with the suction roller 68 and the drive shaft 67, can be axially displaced in the direction of the axis of rotation of the drive shaft 67, is in its zero position and can be displaced toward the right or the left in accordance with the movement arrow 161 by use of a linear drive, not represented in these drawings, but depicted and discussed in a prior section of the application.

The drive torque required for driving the drive shaft 67, and therefore for conveying the sheets 01, is generated by a drive motor 162 and is transmitted to the drive shaft 67 via the third coupling element 144 and the first and second coupling elements 130 or 131.

The sheet position during a later process phase is represented in FIG. 33, into which the sheet 01 has now been moved transversely to the conveying direction 81 for aligning one of its lateral edges 79. In the representation of FIG. 33, the required alignment movement is directed toward the right, which can be seen in particular from the edge offset 163 between the outer edge of the feed table 66 and the outer edge of the downstream-located device. The drive shaft 67 with the coupling elements 130 and 131 fastened thereon has also been axially displaced, together with the feed table 66, in the direction of the axis of rotation of the drive shaft 67.

In the course of the axially directed regulating movement for aligning the lateral edge 79 of the sheet 01, the drive motor 162 was moved on by an angular amount of approximately 90° for conveying the sheet 01 in the conveying direction 81. The compensation of the axial offset of the drive shaft 67 in relation to the drive motor 162 is made possible by the roll-off of the coupling elements 130 or 131 on the rolling bodies 154.

While preferred embodiments of devices for aligning sheets, in accordance with the present invention, have been set forth fully and completely hereinabove, it will be apparent to one of skill in the art that various changes in, for example the type of press used to print the sheets, the specific nature of the downstream sheet handling or processing devices and the like could be made without departing from the true spirit and scope of the present invention which is accordingly to be limited only by the following claims.

What is claimed is:

1. A device for aligning sheets comprising:

an alignment cylinder having an axis of rotation and a circumferential surface;

means supporting said alignment cylinder for movement in a direction of said axis of rotation of said alignment cylinder;

means for rotating said alignment cylinder at a circumferential speed in a direction of sheet travel;

a feed table adapted to guide sheets in a longitudinal plane to said alignment cylinder;

means supporting said feed table for movement in said direction of said axis of rotation of said alignment cylinder; and means for moving said feed table in said direction of said axis of rotation of said alignment cylinder in conjunction with said movement of said alignment cylinder in said direction of said axis of rotation of said alignment cylinder.

2. The device of claim 1 further including at least one recess on said circumferential surface of said alignment cylinder, and means providing a vacuum in said at least one recess, a sheet to be aligned being frictionally held in place on said circumferential surface of said alignment cylinder by said vacuum.

3. The device of claim 1 further including a sheet lateral edge position measuring device adapted to measure an offset of a lateral edge of a sheet in respect to a preset alignment, said device being adapted to align a lateral edge of a sheet in accordance with a measurement provided by said sheet lateral edge position measuring device.

4. The device of claim 1 further including an alignment cylinder drive motor, at least one of an acceleration and speed and angle of rotation of said alignment cylinder drive motor being regulated as a function of an angle of rotation of said alignment cylinder.

5. The device of claim 1 including a downstream arranged sheet receiving device and further including means for deceleration of said alignment cylinder after transfer of a sheet to said downstream-arranged device.

6. The device of claim 1 further including:

means for rotating said alignment cylinder in a direction opposite to said direction of sheet travel.

7. The device of claim 1 wherein said means for rotating said alignment cylinder is an alignment cylinder drive motor and wherein said alignment cylinder can be selectively accelerated and decelerated at a rate of up to 35 $mm/s^2$ by said alignment cylinder drive motor.

8. The device of claim 1 wherein said alignment cylinder has a diameter of between 140 mm and 150 mm.

9. The device of claim 1 further wherein said longitudinal plane extends on said alignment cylinder in a contact area between said alignment cylinder and a sheet and is spaced at a distance from said feed table.

10. The device of claim 1 further including means for adjusting a height of said feed table with respect to said alignment cylinder.

11. The device of claim 1 further including at least one front register lay on said circumferential surface of said alignment cylinder and adapted to align a front edge of a sheet.

12. The device of claim 11 wherein said alignment cylinder circumferential speed is between 0.7 and 0.9 times that of a sheet conveying speed at a time of contact between a sheet leading edge and said front register lays.

13. The device of claim 11 further including means for accelerating said alignment cylinder after contact of a sheet leading edge with said front register lay.

14. The device of claim 11 wherein said alignment cylinder includes at least first and second axially spaced suction rollers, and an alignment cylinder drive shaft supporting said at least first and second suction rollers, at least one of said front register lays being positioned on each said suction roller, each said suction roller having a sheet engaging surface provided with vacuum.

15. The device of claim 11 wherein each said front register lay has a height of between 2 mm and 4 mm above said alignment cylinder circumferential surface.

16. The device of claim 14 further including a fixed suction element supporting each said suction roller, each said fixed suction element being connected to a source of vacuum, each said fixed suction element being located inside of, and supporting an associated suction roller for rotation of said associated suction roller with respect to said fixed suction element, said recesses being provided with said vacuum from said fixed suction elements.

17. The device of claim 16 wherein said source of vacuum is provided in a range of 0.2 to 0.6 bar.

18. The device of claim 14 wherein each said suction roller sheet engaging surface includes a plurality of recesses, said recesses being located on each said suction roller sheet engaging surface starting adjacent said front register lays and extending along said suction roller sheet engaging surface over a defined angle of rotation, a sheet being frictionally securable to said suction roller sheet engaging surface by application of said vacuum to said recesses.

19. The device of claim 18 wherein said defined angle of rotation over which said recesses are extending is between 130° to 200° starting at said front register lays.

20. The device of claim 1 wherein said means for moving said alignment cylinder in said direction of said axis of rotation is a transverse displacement device.

21. The device of claim 20 wherein said transverse displacement device can accelerate and brake said alignment cylinder in the direction of said axis of rotation at a rate of up to +/−15 $M/S^2$.

22. The device of claim 20 wherein said transverse displacement device can displace said alignment cylinder from a zero position up to +/−8 mm in said direction of said axis of rotation of said alignment cylinder.

23. The device of claim 20 further including a first frame element and wherein at least one of said alignment cylinder, said feed table and said first drive motor are mounted on said first frame member, and a second frame member, said first frame member being supported on said second frame member and being shiftable with respect to said second frame member in said direction of said axis of rotation of said alignment cylinder by operation of said transverse displacement device.

24. The device of claim 23 wherein said first frame member is a linear unit seated on a rolling bearing.

25. The device of claim 23 further including a second drive motor for driving said first frame linearly in said direction of said axis of rotation of said alignment cylinder.

26. The device of claim 23 further including a gear between said second drive motor and said first frame element and adapted to transmit power from said second drive motor to said first frame element.

27. The device of claim 1 further including a sheet hold-down roller arranged adjacent said alignment cylinder, said sheet hold-down roller having a hold-down roller axis of rotation parallel to said alignment cylinder axis of rotation.

28. The device of claim 27 wherein said sheet hold-down roller rotates synchronously with said alignment cylinder.

29. The device of claim 27 further including:

means for adjusting a spacing between said alignment cylinder and said sheet hold-down roller.

30. The device of claim 27 wherein said longitudinal plane extends on said sheet hold-down roller at a distance from said feed table in a contact area between said alignment cylinder and a sheet.

31. The device of claim 27 wherein said sheet hold-down roller is helical in cross-section.

32. The device of claim 31 wherein said helical sheet hold-down roller has a maximum diameter portion and wherein said maximum diameter portion of said sheet hold-down roller engages a sheet during alignment of a front edge of the sheet.

33. The device of claim 1 further including a hold-down plate above said feed table and defining to a space between said feed table and said hold-down plate.

34. The device of claim 33 wherein an amount of said space between said feed table and said hold-down plate is adjustable as a function of an angle of rotation of said alignment cylinder.

35. The device of claim 34 wherein said amount of said space between said hold-down plate and said alignment cylinder changes in an oscillating manner in accordance with rotation of said alignment cylinder, said amount of said space being at a minimum during alignment of a front edge of a sheet on said alignment cylinder and increased to a maximum during conveyance of a sheet past said alignment cylinder.

* * * * *